United States Patent [19]

Niimura

[11] Patent Number: 5,025,512

[45] Date of Patent: Jun. 25, 1991

[54] FLOORING APPARATUS FOR POOL OR THE LIKE

[76] Inventor: Masateru Niimura, 4-4, Oomorinishi, 6-chome, Oota-ku, Tokyo 143, Japan

[21] Appl. No.: 184,636

[22] PCT Filed: Aug. 26, 1987

[86] PCT No.: PCT/JP87/00630

§ 371 Date: Apr. 20, 1988

§ 102(e) Date: Apr. 20, 1988

[87] PCT Pub. No.: WO88/01672

PCT Pub. Date: Mar. 10, 1988

[30] Foreign Application Priority Data

| | | | |
|---|---|---|---|
| Aug. 26, 1986 | [JP] | Japan | 61-198235 |
| Aug. 26, 1986 | [JP] | Japan | 61-198236 |
| Feb. 20, 1987 | [JP] | Japan | 62-35878 |
| Mar. 23, 1987 | [JP] | Japan | 62-65790 |
| May 20, 1987 | [JP] | Japan | 62-75782 |
| May 20, 1987 | [JP] | Japan | 62-75783 |
| May 20, 1987 | [JP] | Japan | 62-123127 |

[51] Int. Cl.[5] ..... E04H 4/00

[52] U.S. Cl. ..... 4/495; 250/229; 187/76

[58] Field of Search ..... 4/495, 498, 499, 506, 4/560, 564, 565, 566; 52/66; 187/8.59, 8.47, 27, 35, 76, 80, 8.49, 8.5; 250/229; 74/155

[56] References Cited

U.S. PATENT DOCUMENTS

| | | | |
|---|---|---|---|
| 2,849,084 | 8/1958 | Hott et al. | 187/8.5 |
| 2,931,461 | 4/1960 | Lawson | 187/8.59 |
| 3,045,253 | 7/1962 | Price | 4/501 |
| 3,052,893 | 9/1962 | McClure | 4/495 |
| 3,165,600 | 1/1965 | Chasar et al. | 187/35 |
| 3,412,409 | 11/1968 | Putney | 4/498 |
| 3,565,217 | 2/1971 | St. Louis | 187/27 |
| 3,941,213 | 3/1976 | Stammen | 187/35 |
| 3,980,980 | 9/1976 | Zioni et al. | 250/229 |
| 4,196,348 | 4/1980 | Iwakiri et al. | 250/229 |
| 4,223,217 | 9/1980 | Bongard et al. | 250/229 |
| 4,229,843 | 10/1980 | Belanger | 4/495 |
| 4,271,542 | 6/1981 | Wood et al. | 4/495 |
| 4,364,131 | 12/1982 | Clerk | 4/498 |
| 4,531,614 | 7/1985 | Naegeli | 187/8.5 |
| 4,577,352 | 3/1986 | Gautheron | 4/498 |
| 4,674,938 | 6/1987 | Van Stokes ete al. | 187/8.59 |

FOREIGN PATENT DOCUMENTS

| | | | |
|---|---|---|---|
| 1914286 | 10/1970 | Fed. Rep. of Germany | 4/495 |
| 1376488 | 9/1964 | France | 187/8.59 |
| 0885599 | 12/1961 | United Kingdom | 187/8.5 |
| 0912746 | 12/1962 | United Kingdom | 187/80 |

*Primary Examiner*—Ernest G. Cusick
*Assistant Examiner*—Casey Jacyna
*Attorney, Agent, or Firm*—Wenderoth, Lind & Ponack

[57] ABSTRACT

The flooring apparatus for pool or the like comprises an elevating floor formed almost identically with an opening area of a pool or the like, an elevator for moving the elevating floor vertically, and a means for holding the elevating floor at a desired level position, the elevating floor can be set securely and solidly at a desired level position on a small power by sealing the elevating floor hermetically with air for a buoyancy coming almost zero underwater, further one pool can be used for multiple purpose of adults' use, children's use, infants' use and others, thus providing a flooring apparatus for pool or the like which is simple in construction and moderate in cost.

7 Claims, 29 Drawing Sheets

FIG. 13
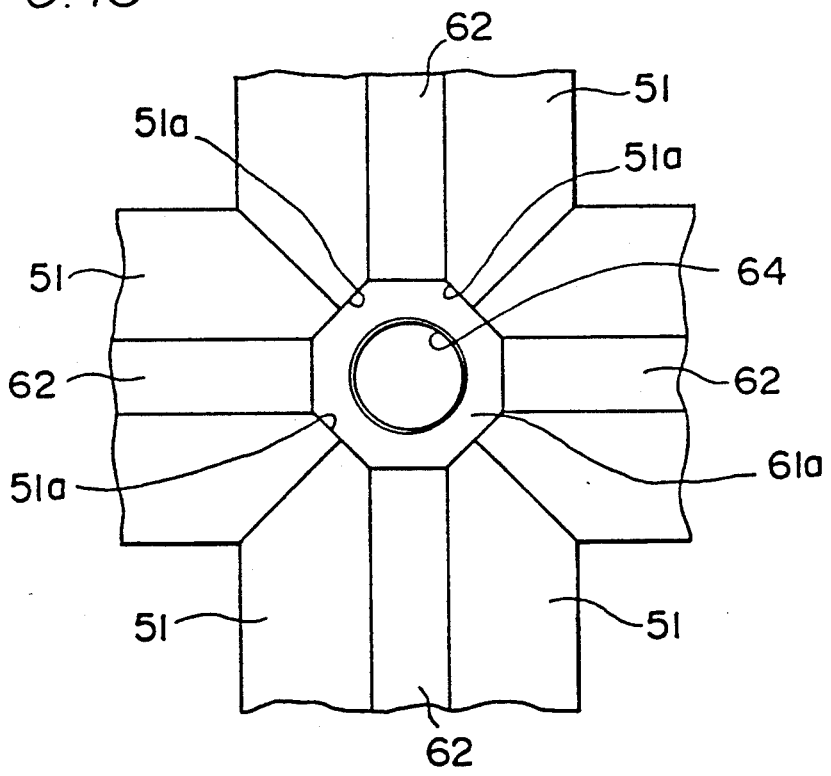
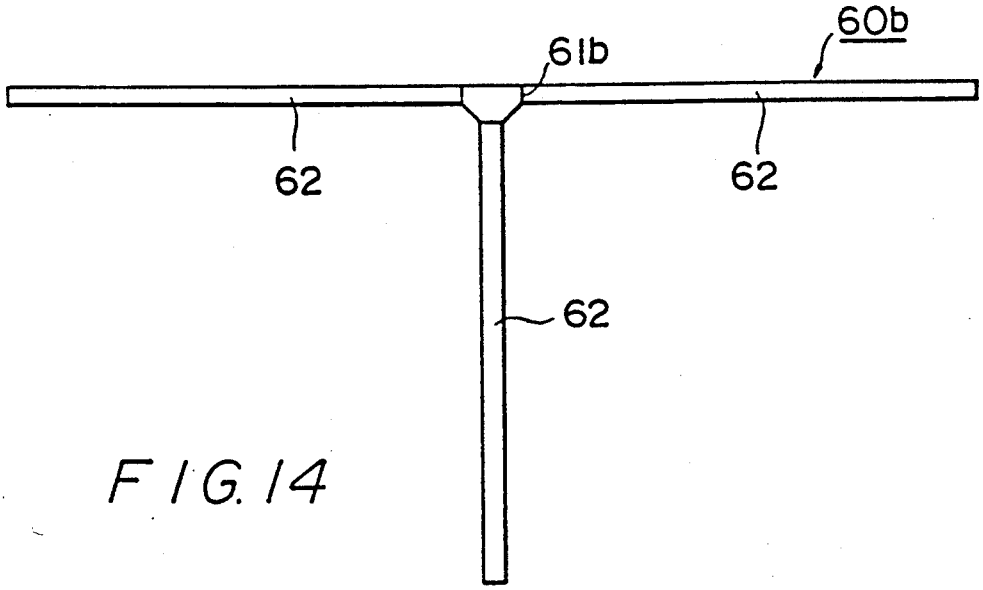
FIG. 14

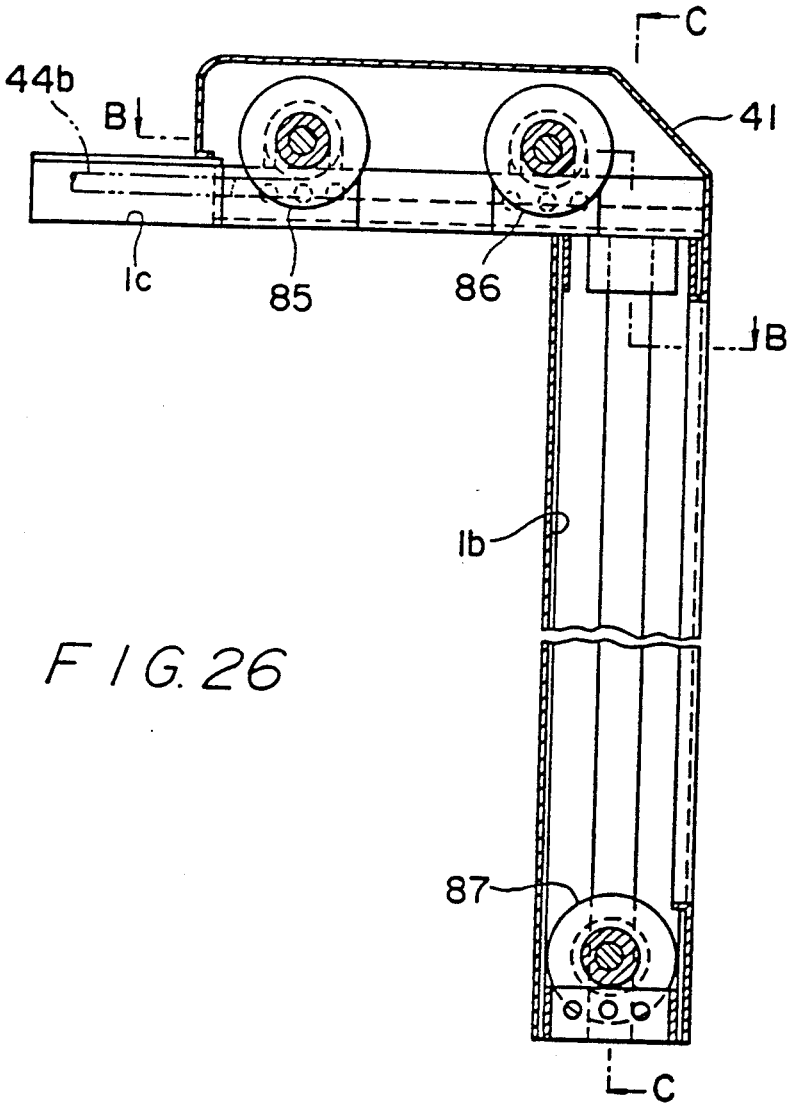
FIG. 26
FIG. 27
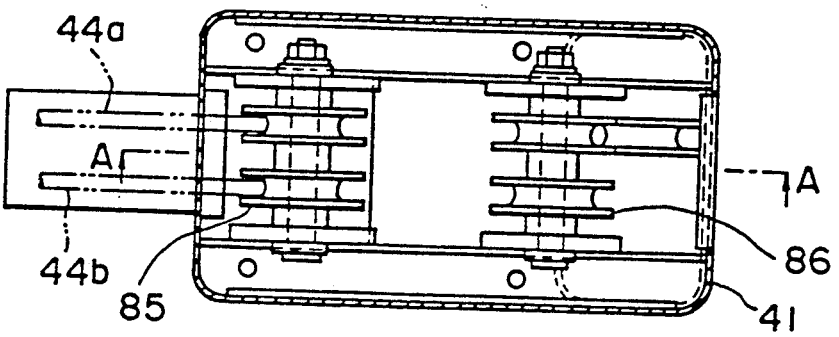

FLOORING APPARATUS FOR POOL OR THE LIKE

TECHNICAL FIELD

This invention relates to a flooring apparatus for pool or the like which is capable of setting a floor of pool or the like solidly and securely at a desired level position.

BACKGROUND ART

According as the consciousness for health care is uplifted, swimming becomes very popular as a sport ready for enjoying by young and old irrespective of age, and thus many facilities such as swimming club and the like are now developed.

However, the situation is such that pools provided for those facilities are formed, in most cases, to a depth adaptable only to the swimming of adults, and hence the depth must be adjusted and shallowed to cope with the occasional swimming, if so, by children or infants, accordingly various apparatuses capable of adjusting the depth of pools arbitrarily have ever been proposed.

With reference to FIG. 42 representing one example thereof, the method comprises arranging a multiplicity of beds 4 having legs 3 each on a fixed floor level 2 of a pool 1, removing the beds 4 when intended for swimming by adults.

However, such prior art means involves a problem that the work for carrying in and removing the beds 4 requires much time for adjusting the depth, and the work is very complicated.

To solve the problem mentioned above, there is proposed a floor elevator of the pool 1, as shown in FIG. 43, which is constructed such that a floor 5 of the pool 1 is formed thick in wall, a plurality of compressed air passages 6 are provided in the floor 5, a multiplicity of concertina struts 7 are mounted on the compressed air passages 6 each to support a drainboardlike moving floor 8, each compressed air passage 6 is connected to a compressor 9, a compressed air is inserted in the concertina struts 7 from the compressor 9, thereby adjusting a level of the moving floor 8.

However, a problem is still quite unavoidable with the aforementioned prior ar& floor elevator of the pool 1, as the fixed floor 5 of the existing pool 1 must be broken before installing it thereon, thus a cost of construction is increased so much, the pool 1 cannot be used during the term of construction and so forth.

This invention ha been done in view of the circumstances mentioned above, and it is an object of the invention to provide a flooring apparatus for pool or the like, wherein the floor of a pool or the like can be set easily and quickly at a desired level position, further it can be installed without breaking a fixed floor of the existing pool, a term of construction is extremely shortened, and a cost of construction is moderate.

DISCLOSURE OF THE INVENTION

In order to attain the aforementioned object, the invention comprises elevating a floor fitted in an opening of pool or the like and given a proper buoyancy up to a desired position by a proper means and then stopping it thereat.

In the invention, the aforementioned elevating floor is charged with air so that a full weight of the elevating floor and a buoyancy are offset each other to "zero" underwater.

Further, the elevating means of the floor in the invention is constituted of a plurality of hollow guide rails engaged with an opposite side wall of a pool or the like and guiding the aforementioned floor for elevation, a plurality of take-up pulleys provided rotatably on a pool side, a plurality of wire ropes with one end connected to the take-up pulley and the other end connected to the elevating floor through the guide rail each, thus the elevating floor is moved vertically along the guide rails according to a rotation of the aforementioned take-up pulleys.

Further, the means for holding the elevating floor of pool or the like at a desired level position in the invention is constituted of a plurality of locking claws energized outward of the elevating floor, a claw locking member fixed on an opening of the pool or the like, thus the elevating floor is supported securely and solidly at the desired level position by the locking claws and the claw locking member, and for facilitating a resetting operation, the holding means is made to descend smoothly down to the bottom surface after the elevating floor is elevated to the uppermost position.

BRIEF DESCRIPTION OF THE DRAWINGS

FIG. 13 is a plan view, partly cutaway, showing the state where the square panel and the cross coupling member are coupled together; FIG. 14 is a plan view of a T-shaped coupling member; FIG. 26 is a sectional view taken on line A—A of FIG. 27; FIG. 27 is a sectional view taken on line B—B of FIG. 26.

BEST MODE FOR CARRYING OUT THE INVENTION

Figure 1:
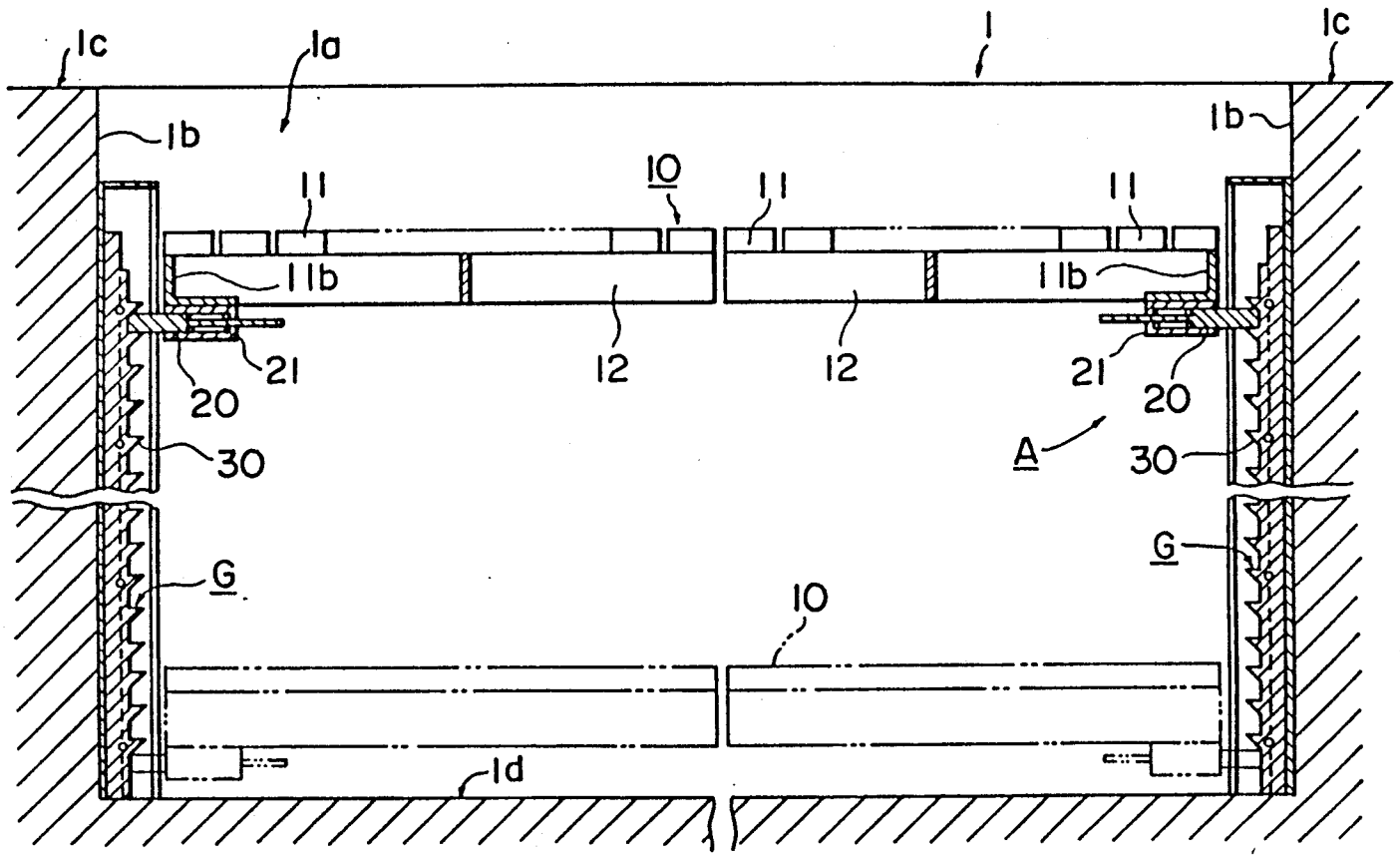
FIG. 1 is a sectional view showing a flooring apparatus for pool or the like which is given in a first embodiment of the invention.

The invention will now be described in detail with reference to a preferred embodiment.

A pool flooring apparatus A relating to the embodiment comprises an elevating floor 10 disposed in the pool 1, a locking claw 20 disposed on a side of the elevating floor 10, a claw locking member 30 with which the locking claw 20 is engaged, an elevator 40 for moving the elevating floor 10 vertically.

The elevating floor 10 comprises, as shown in FIG. 3 to FIG. 7, a multiplicity of aluminum, stainless steel or synthetic resin cylindrical floorings 11, and a rectangularly-assembled support frame 12 disposed under the floorings 11 to support them fixedly.

The floorings 11 are arrayed in parallel with each other, and in the case of a pool 5 m wide and 15 m long, for example, the multiplicity of floorings 11 are assembled rectangularly and fixed on a top of the support frame with bolt/nut 13 or the like, accordingly.

Each flooring 11 is charged with air in the hollow interior and hermetically sealed by a plug 15 such as rubber cap or the like which is fitted in both ends thereof. From constructing such, a buoyancy is given to the elevating floor 10 underwater to decrease the weight, and particularly from charging the flooring 11 partly with air to seal hermetically by the plug 15 and detaching the other plug 15 for the remaining flooring 11, an underwater weight of the elevating floor 10 can be adjusted properly. In this case, the underwater weight of the elevating floor 10 will be reduced to zero from balancing the full weight with the buoyancy, thus minimizing a driving force required for moving the elevating floor 10 vertically underwater.

The support frame 12 comprises, as shown in FIG. 8 to FIG. 15, a plurality of square panels 50, and a plurality of coupling members 60 for coupling the square panels 50 disposed adjacently each other horizontally.

Figure 10:
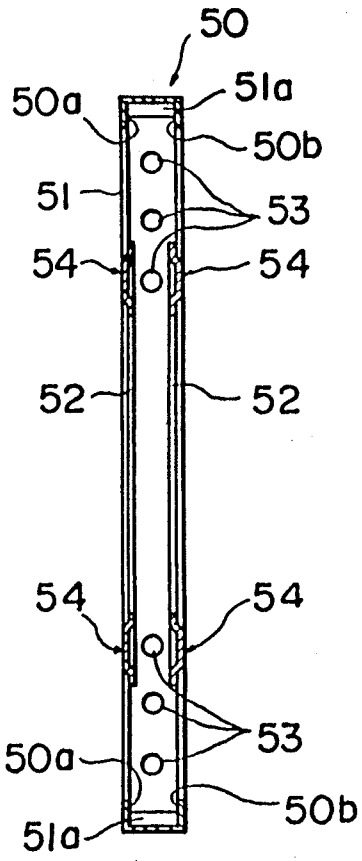
FIG. 10 is a sectional view of the square panel.
Figure 9:
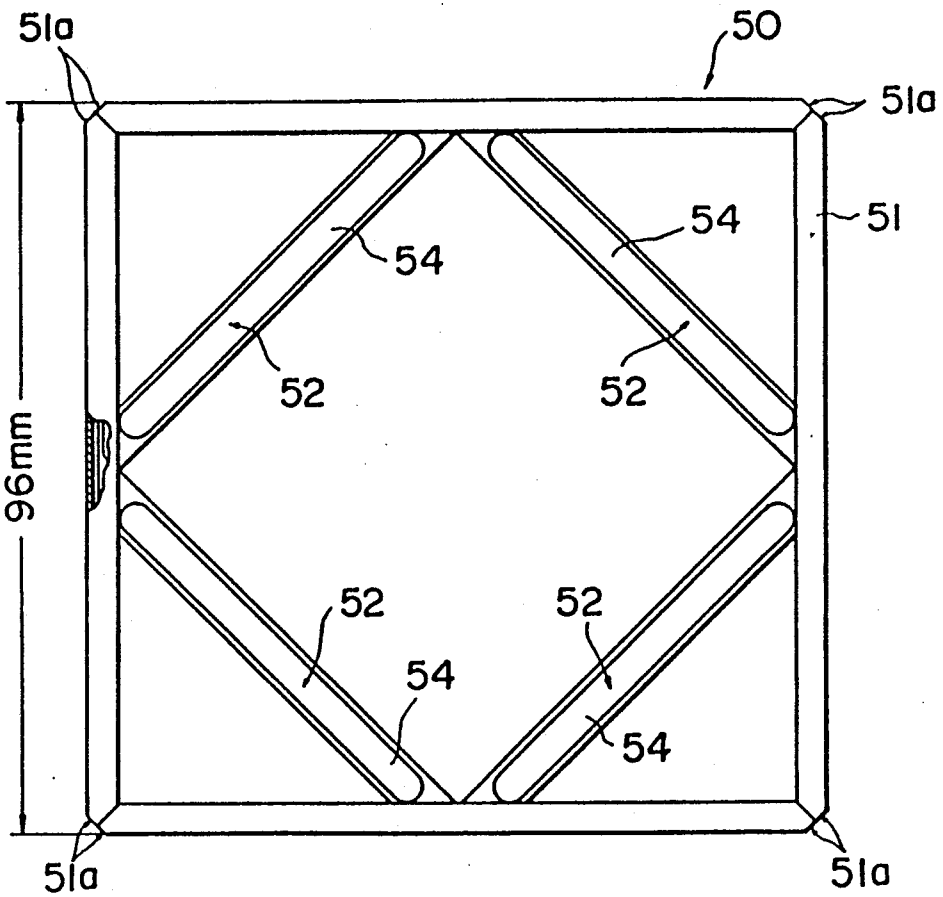
FIG. 9 is a plan view of a square panel constituting the support frame.

As shown particularly in FIG. 9 and FIG. 10, the square panel 50 is formed to have four frame members 51 U-shaped in section welded squarely, a flint member 52 is laid at a corner portion of each frame member 51, and materials lightweight essentially or ready for lightweighing such as aluminum, synthetic resin, stainless steel and the like are desirable as constituent of the frame member 51 and the flint member 52.

The frame member 51 has each side formed a little less than 1 m in length, inclined planes 51*a*, 51*a* are formed on both end portions thereof, and it is formed to be almost trapezoidal entirely. Then, a reference numeral 53 in FIG. 10 denotes a bolt insertion hole provided at given intervals, and, while not indicated, a coupling bolt is inserted in the bolt insertion hole 53.

The flint member 52 is constituted of a plate, slender, long and trapezoidal, and as shown in FIG. 9 and FIG. 10, a salient rib 54 is provided longitudinally thereof, which is effective in ensuring a proper proof stress against bending force, and a top of the salient rib 54 and an outer surface of the square panel 50 will be of a plane in case the flint member 52 and the square panel 50 are fixed together through welding or the like.

The flint member 52 constructed as above is laid between upper edge flanges 50*a* and also between lower edge flanges 50*b* of the square panel 50.

Figure 11:
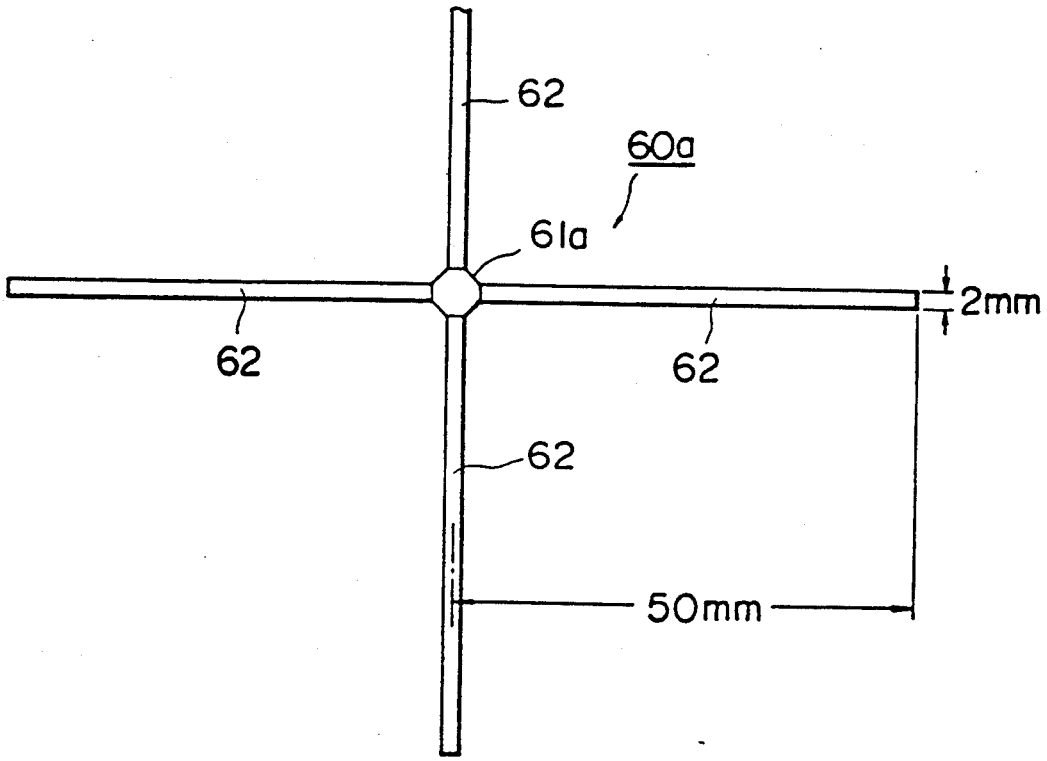
FIG. 11 is a plan view of a cross coupling member.
Figure 12:
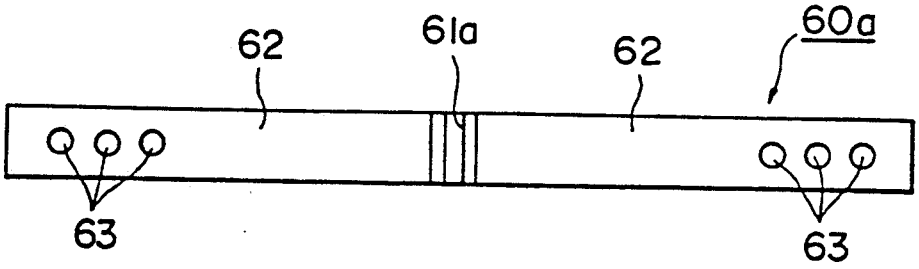
FIG. 12 is a front view of the cross coupling member.

The coupling member 60 comprises, as shown in FIG. 11 and FIG. 12, a cylindrical member 61*a*, a coupling member 60*a* formed almost crosswise in plane by four pieces of flat plate members 62 extended outward of an outer peripheral surface of the cylindrical member 61*a*, a cylindrical member 61*b* split almost half, a coupling member 60*b* formed almost into T-shape in plane by three pieces of flat plate members 62 extended outward of an outer peripheral surface of the split cylindrical member 61*b*, a coupling member 60*c* formed almost into L-shape in plane by two pieces of flat plate members 62.

The flat plate member 62 is formed to have a thickness at 1 m as a whole when including a plane size of the square panel 50, formed to have a length at 50 cm which is almost half of the length of the frame member 51, and is also formed to have a height even with the square panel 50.

Then, as shown in FIG. 12, a necessary number of bolt insertion holes 63 are perforated in the flat plate member 62, and each bolt insertion hole 63 is provided at a position concentric with the bolt insertion hole 53 formed through the square panel 50.

Figure 16:
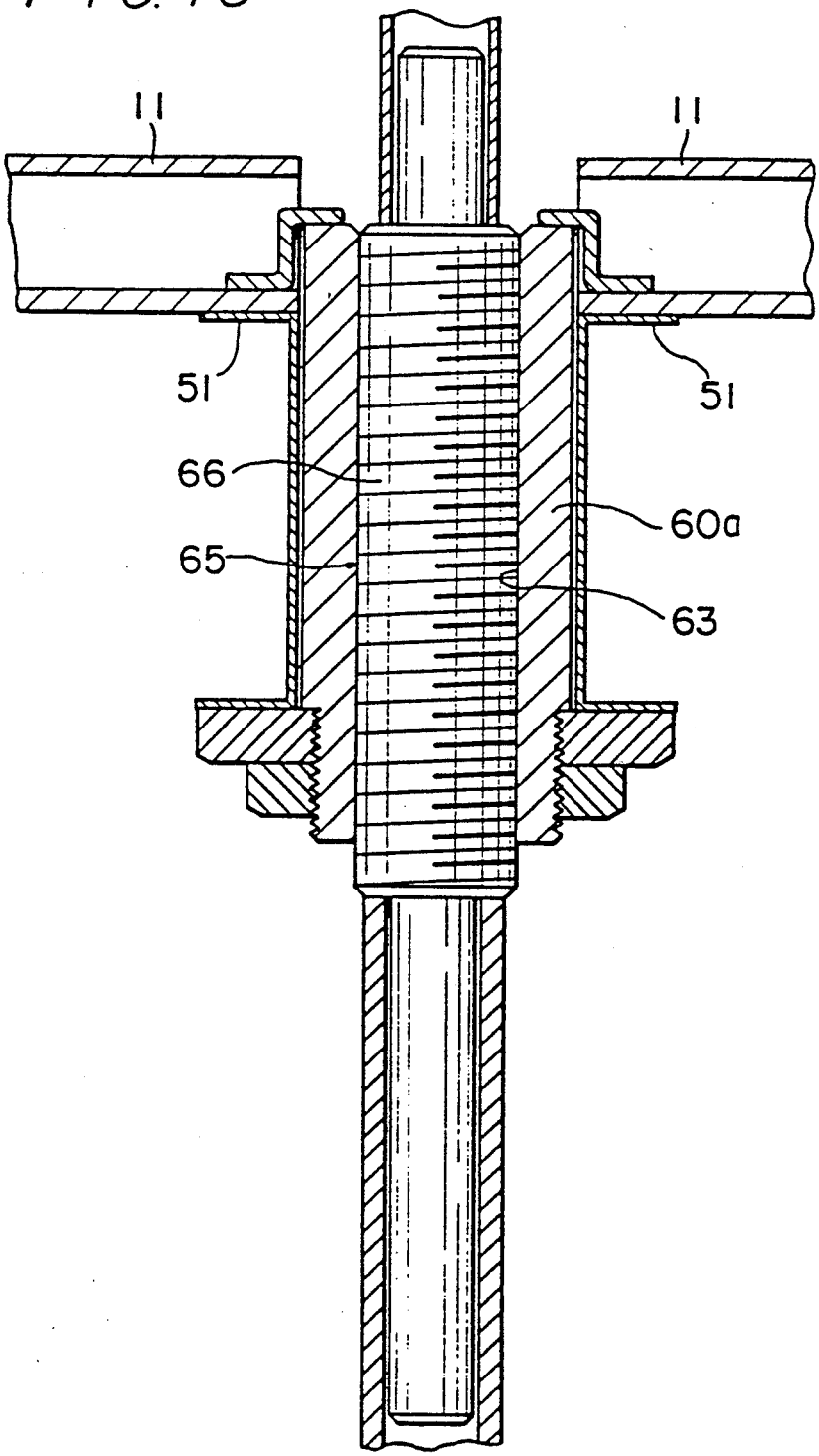
FIG. 16 is a sectional view showing another support structure of the elevating floor.

The cylindrical member 61*a* is formed into an octagon in plane so as to coincide with corners of the square panel 50, and as shown particularly in FIG. 13, base portions of the flat plate members 62 are coupled thereto every other side through welding or other means, and a female screw 64 is provided on an inner circumferential wall surface. A support rod 66 with a male screw 65 provided on an outer peripheral surface is screwed, as shown in FIG. 16 for example, in the female screw 64, thereby supporting the elevating floor 10 at a desired level position from the ground surface.

The coupling member 60*b* is disposed, as shown in FIG. 14, within the square panel 50 constituting an outer edge portion of the floor.

Figure 15:
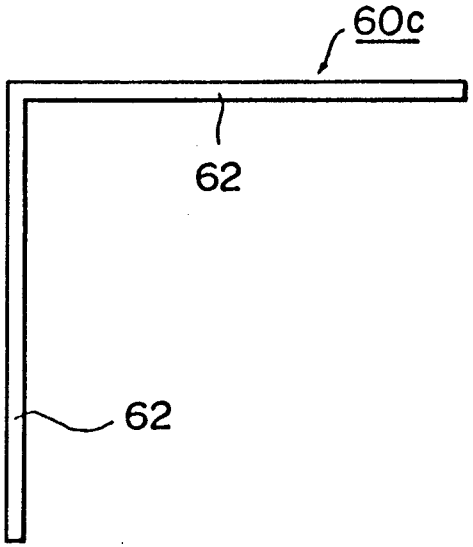
FIG. 15 is a plan view of an L-shaped coupling member.

Then, the coupling member 60*c* is disposed, as shown particularly in FIG. 15, on a corner of the square panel constituting an outer edge portion of the floor.

Figure 8:
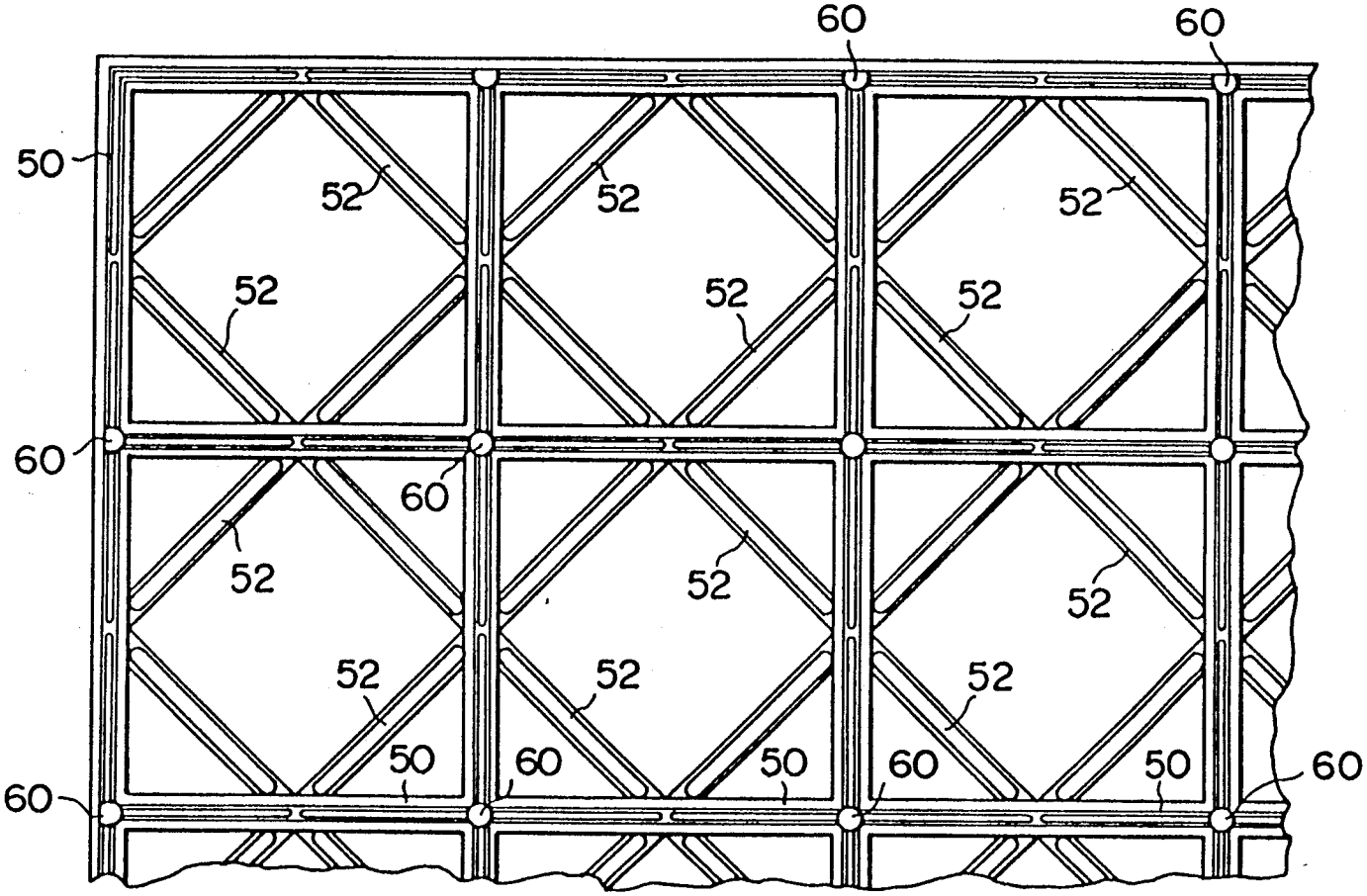
FIG. 8 is a plan view showing another example of the support frame.

Referring next to the case where the support frame 12 constructed as above is built up, when, for example, the pool 1 is 15 m wide and 25 m long, the square panel 50 with the sides formed a little less than 1 m each is prepared in 375 pieces all told or 15 pieces in cross direction and 25 pieces longitudinally, the crosswise coupling member 60*a* is prepared in 336 pieces, the T-shaped coupling member 60*b* is prepared in 76 pieces and the L-shaped coupling member 60*c* is prepared in 4 pieces, these are arranged, as shown in FIG. 8, so as to coincide with an opening shape of the pool A, and each coupling member 60 and the square panel 50 are coupled together with bolts and nuts (not indicated). In this case, since the length is set exactly at 1 m by the square panel 50 and the coupling member 60 as will be apparent from what has been described above, a dimensional error is not capable of arising therefrom.

Next, a necessary number of floorings 11 are placed in parallel orderly on a top of the support frame 12 built up as above, and the floorings 11 are locked with bolts and nuts 13. In this case, heads of the bolts and nuts 13 are covered with a cap 14 which will be described hereinlater, therefore an external appearance will not be spoiled and no injury may result.

Then, aluminum or synthetic resin such as toughened plastics or the like is used as a material for the support frame 12, and hence it can be applied to a floor of playground structures, buths and so forth.

Further, the square panel 50 is not necessarily limited to a square with the sides formed a little less than 1 m in length each, but can be sized properly as, for example, two-split (approx. 1 m × approx. 50 cm), four-split (approx. 50 cm × approx. 50 cm), or one side being 1 m or longer, and the shape may take various forms otherwise such as rectangle and the like.

Still further, the cylindrical coupling member 60 is not necessarily limited to a regular octagon but can be formed into various shapes.

Figure 6:
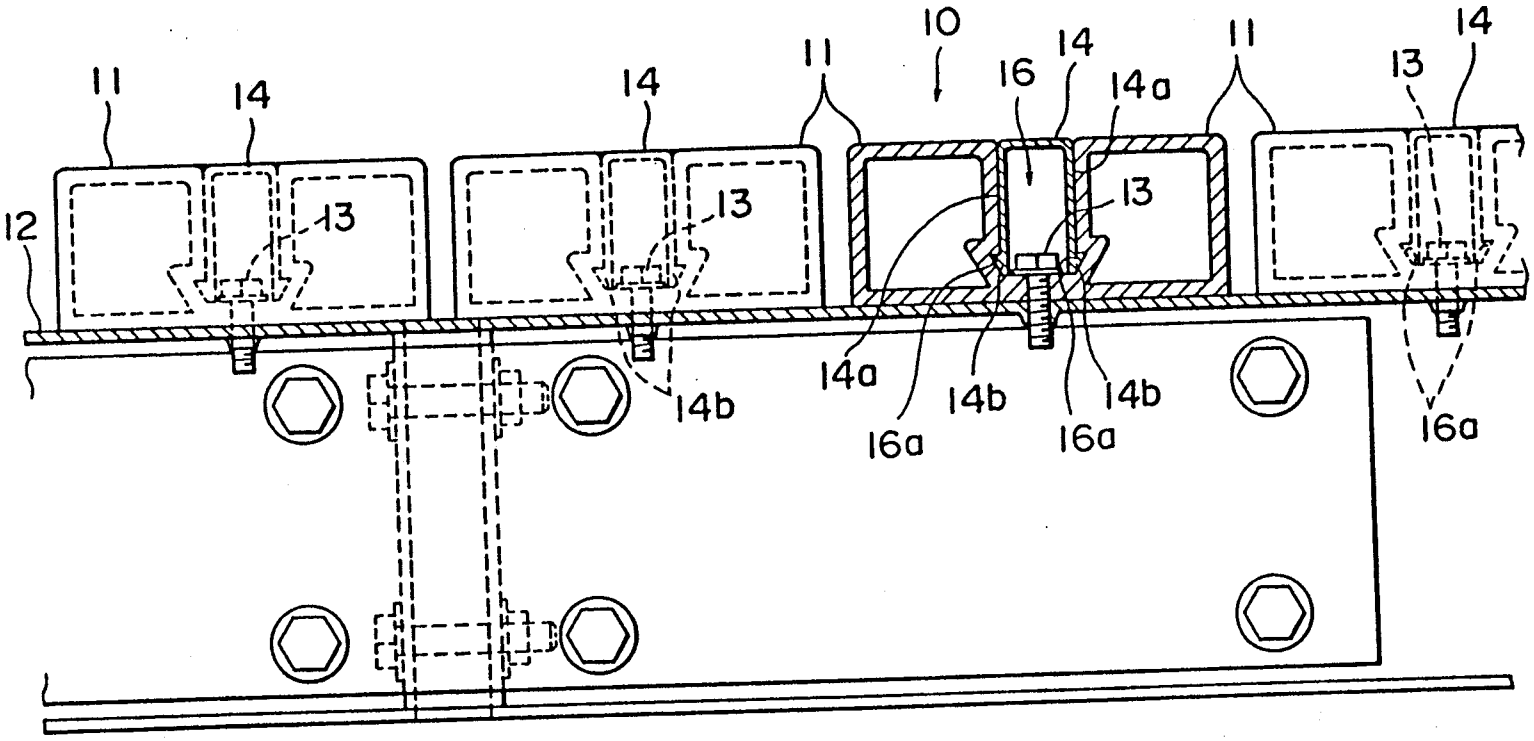
FIG. 6 is an enlarged sectional view showing the state where a flooring and the support frame are coupled together.

The cap 14 is inserted in a recession 16 formed between the floorings 11 as shown in FIG. 6, and a projection **14*b* engaging with a >-shaped groove 16*a* provided on lower end portions of both walls of the recession 16 is formed as swelling on lower end portions of legs 14*a*, 14*a*. From constructing the cap 14 such, a head of the bolt/nut 13 coupling the flooring 11 and the frame member 12 together is hidden by the cap 14 to enhance an external appearance of the floor and also to prevent injury due to the bolt/nut 13**.

Figure 17:
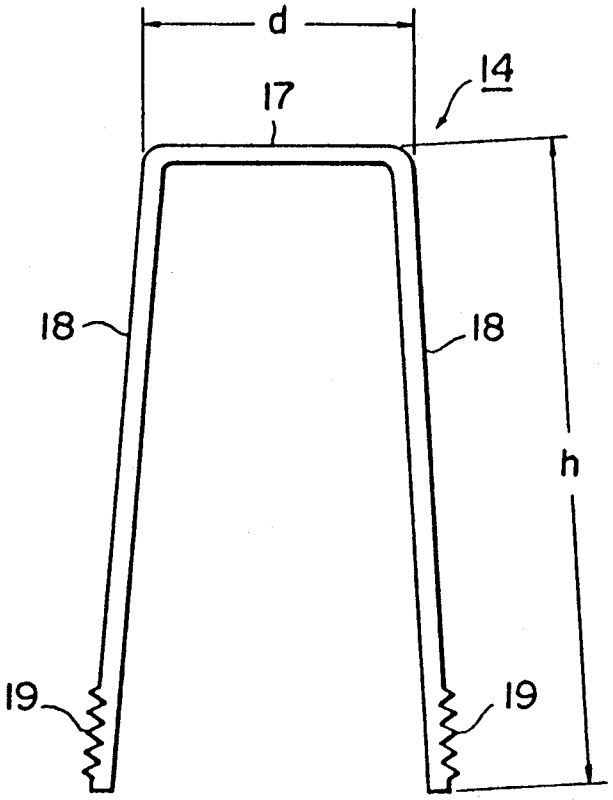
FIG. 17 is a front view showing another example of a cap.
Figure 18:
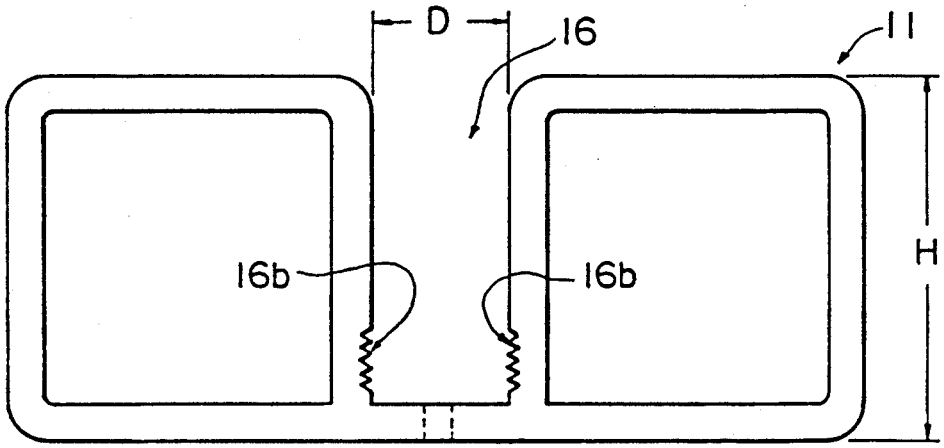
FIG. 18 is a front view showing another example of the flooring.
Figure 19:
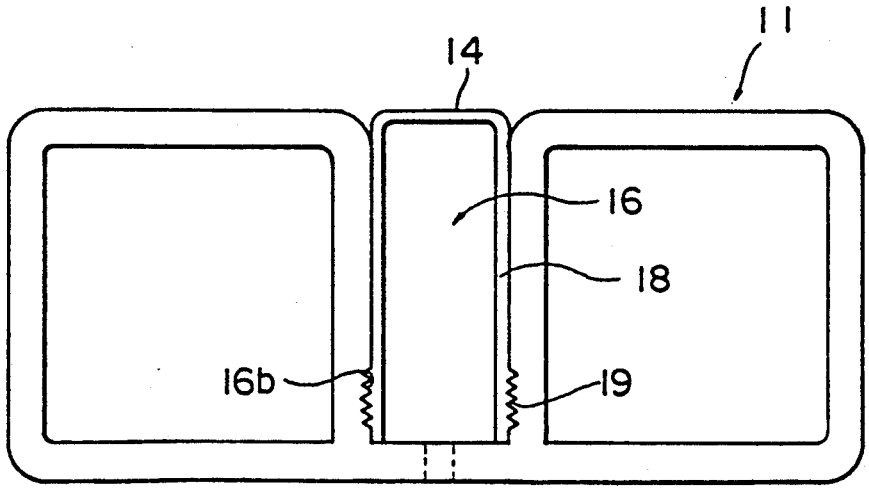
FIG. 19 is a front view showing the state where the flooring and the cap are coupled together.

Then, FIG. 17 to FIG. 19 represent a variation of the cap 14 each and the cap 14 relating to the example is formed almost into an inverted U shape by a plane portion 17 having a width d almost same dimensionally as a width D of the recession 16 formed between the floorings 11, and legs 18, 18 having a height h almost same dimensionally as a depth H of the recession 16, the legs 18, 18 are constructed to have an elasticity as opened somewhat outward, and an engaging projection 19 is formed continuously into "<" shape on lower end outer surfaces of the legs 18, 18. The engaging projection 19 is constructed to engage with a "<"-shaped groove **16*b* formed on the recession 16. Then, the cap 14 can be disengaged easily from the engaging groove 16*b*** by inserting a driver or other means in the gap.

Figure 20:
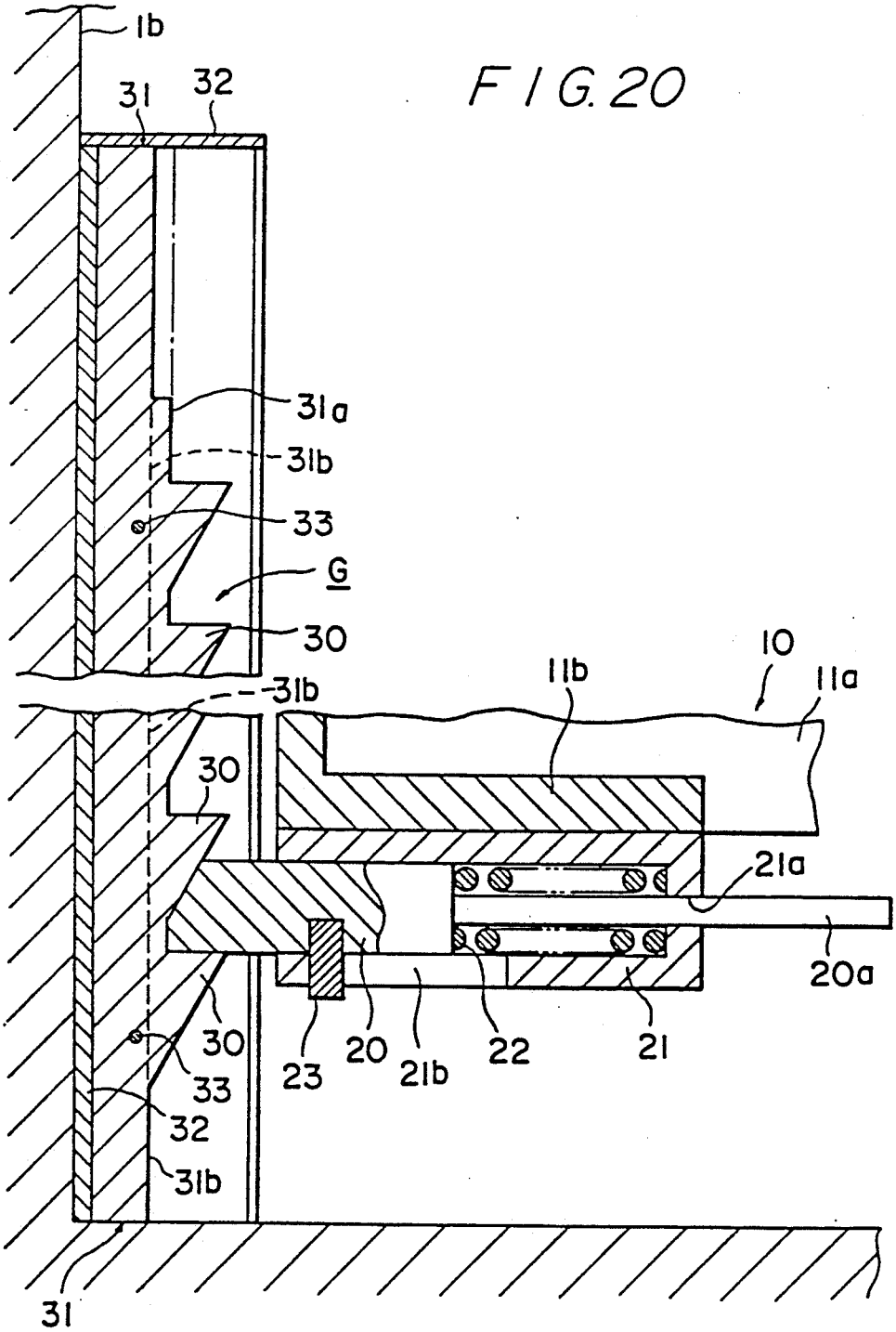
FIG. 20 is an enlarged sectional view showing the state where a locking claw is engaged with a claw locking member.

A plurality of locking claws 20 are disposed on a lower surface of the elevating floor 10 assembled as above, and as will be apparent from FIG. 1 and FIG. 20, a nose of each locking claw 20 is disposed opposite to an inside wall surface **1*b* of the pool 1**.

Each locking claw 20 is provided withdrawably within a holder 21 fixed on a core **11*b* constituting a reinforcement member 11*a* of the elevating floor 10. Then, a guide rod 20*a* is provided extendedly on a rear end side of each locking claw 20, and the guide rod 20*a* is inserted in an insertion hole 21*a* of the holder 21**.

Further, each locking claw 20 is energized normally forward through a spring 22 enclosed within the holder 21.

Figure 3:
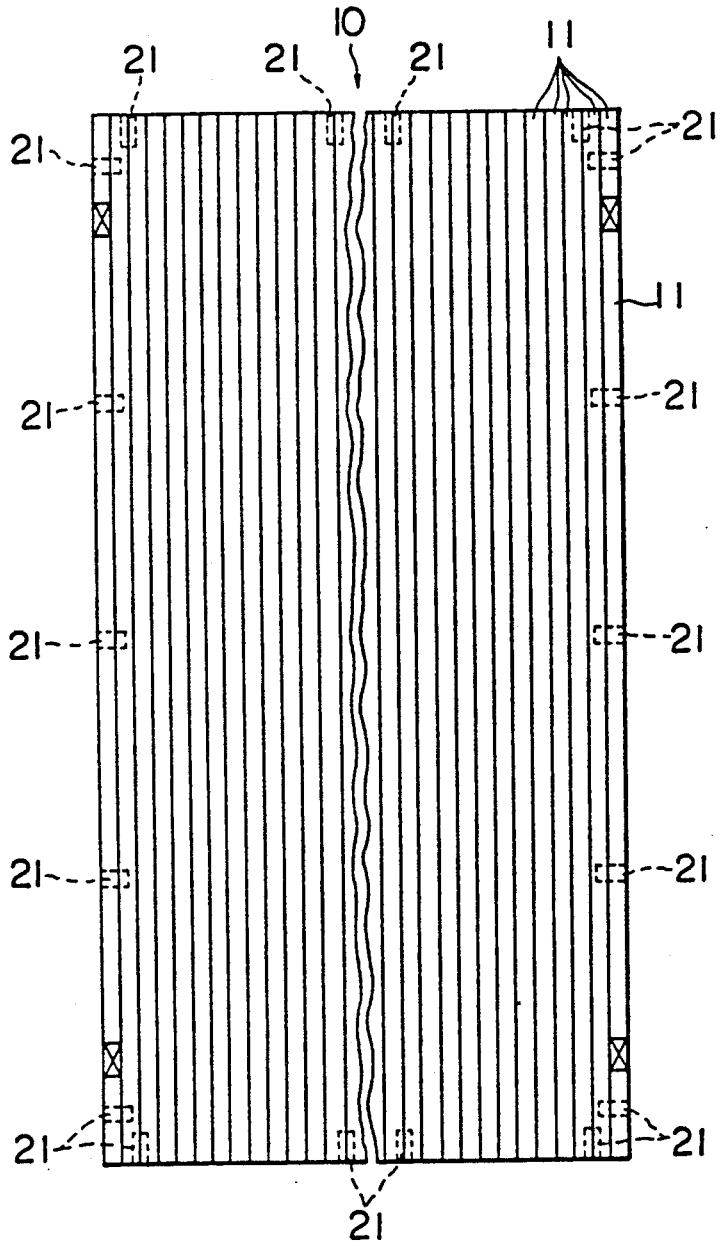
FIG. 3 is a plan view of an elevating floor.
Figure 4:
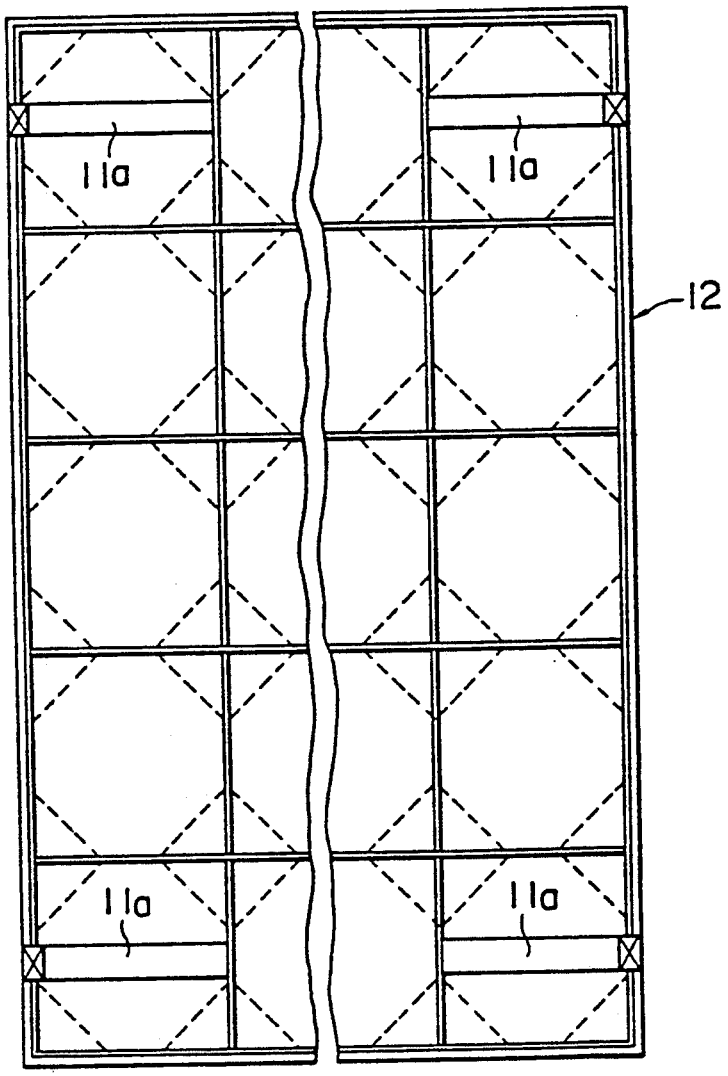
FIG. 4 is a plan view of a support frame.
Figure 5:
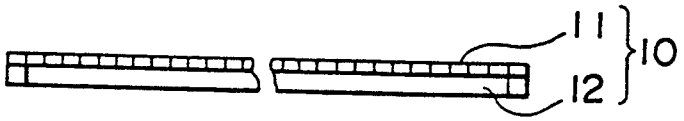
FIG. 5 is a side view of the elevating floor.
Figure 7:
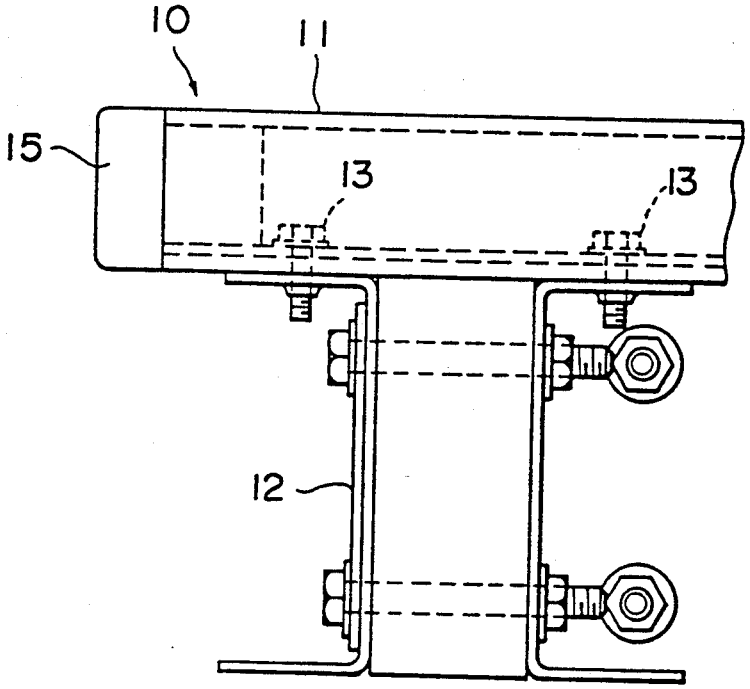
FIG. 7 is a side view showing a coupled state of an end portion of the flooring.

Then, each holder 21 is disposed, as shown also in FIG. 3, at proper intervals on a periphery of the elevating floor 10 on a lower surface side.

A reference numeral 23 in FIG. 20 denotes a guide pin provided on each locking claw 20, and the guide pin 23 is inserted in a guide groove **21*b* of the holder 21, constructed withdrawably in the holder 21 of each locking claw 20, and also to prevent each locking claw 20 from coming off the holder 21**.

On the other hand, the claw locking member 30 on which each locking claw 20 is locked is disposed on the inside wall surface **1*b* of the pool 1 to which each locking claw 20** is opposite.

The claw locking member 30 is provided extendedly and vertically to form, as shown in FIG. 1 and FIG. 20, a locking member group G, and is enclosed within a box 32 fixed on the inside wall surface **1*b* of the pool 1**.

The locking member group G is formed like saw teeth longitudinally of a guide rail 31 formed of a material such as, for example, nylon, polyacetal, polyester, polycarbonate or the like which is wear resisting and corrosion-proof, and the construction is such that the elevating floor 10 is stopped descending when each claw locking member 30 and the locking claw 20 are engaged with each other.

Figure 21:
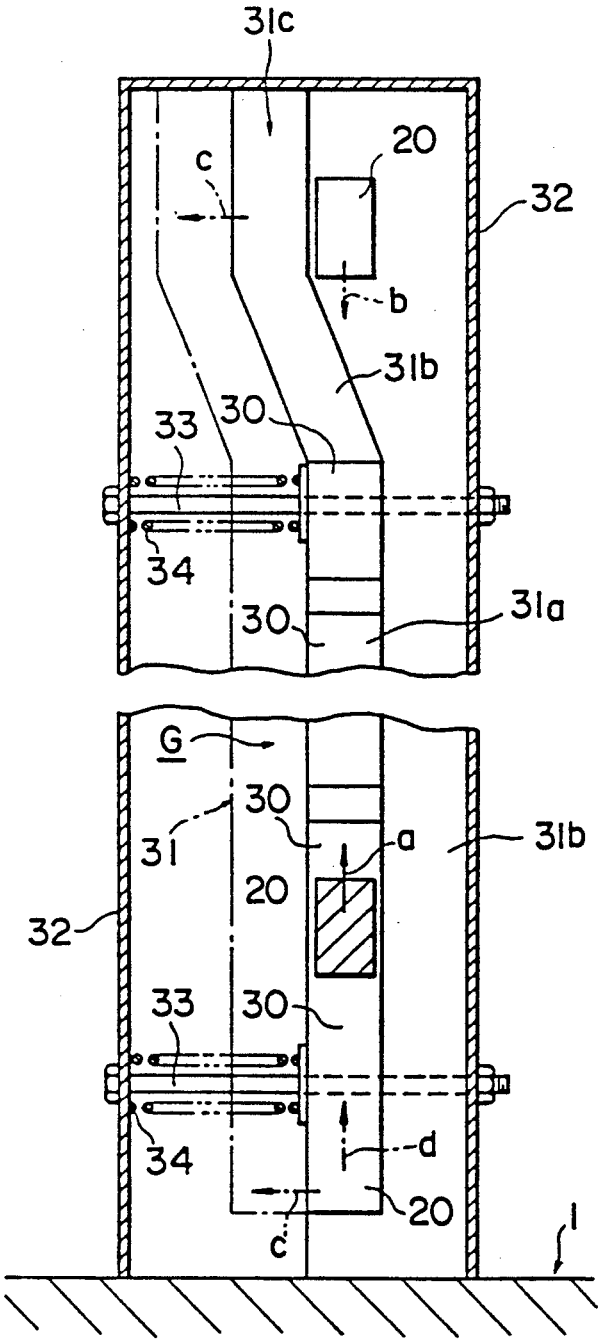
FIG. 21 is an explanatory drawing showing a sliding state of the locking claw and a guide rail.

The guide rail 31 holds a guide rod 33 disposed in cross direction of the box 32 as shown in FIG. 21, and is capable of moving horizontally (horizontally in FIG. 21) within the box 32 along the guide rod 33.

Then, a double-directional spring 34 is interposed in a shaft of the guide rod 33 disposed on the left side of the guide rail 31, and the spring 34 holds the guide rail 31 normally at a neutral position.

An inclined portion **31*b* inclined upward on the left side of FIG. 21 is provided connectedly to an upper end of a straight portion 31*a* of the claw locking member 30 constructed as above, and again a straight portion 31*c* is provided connectedly to an upper end of the inclined portion 31*b***.

Accordingly, the locking claw 20 is kept on the straight portion **31*a*, as shown in FIG. 21, and when starting to ascend from the position as indicated by an arrow d in FIG. 21, the locking claw 20 slides on the inclined portion 31*b*. In this case, since the locking claw 20 moves and ascends vertically, the guide rail 31 is moved forcedly rightward of FIG. 21 against a force of the spring 34**.

When the locking claw 20 slides to the straight portion **31*c* and arrives at the uppermost position, the locking claw 20 disengages from a notch (not indicated) formed on an upper end portion of the guide rail 31, the locking claw 20 and the guide rail 31 are disengaged each other, and thus the guide rail 31 is pulled on a force of the spring 34** and returns to a home position (neutral position).

When the locking claw 20 starts descending next, the locking claw 20 descends as sliding on a side portion (right side portion in FIG. 21) of the guide rail 31, and when it arrives at a side portion of the inclined portion **31*b*, it descends as depressing the guide rail 31 in a compressing direction (leftward of FIG. 21) of the spring 34 and keeps to descend along a side portion of the straight portion 31*a*** as holding the depressing state.

Then, when the locking claw 20 arrives at the lowermost position, it comes into the guide rail 31 from a notch (not indicated) formed on a lower end portion of the guide rail 31, and thus the locking claw 20 and the guide rail 31 come into an engaged stat each other. Consequently, the guide rail 31 is depressed on a force of the spring 34 and returned to the home position (neutral position).

Needless to say, the elevating floor 10 is set at a desired level position from stopping the locking claw 20 ascending when the locking claw 20 is locked on the desired claw locking member 30. In this case, even where the locking claw 20 is set at a position intermediate of the claw locking members 30, 30, the elevating floor 10 descends somewhat if a load works on the elevating floor 10, however, since it is engaged securely and solidly with the predetermined claw locking member 30 on a force of the spring 22, a safe support state is obtainable securely.

Then, in the aforementioned example, the case where the locking claw 20 is fixed on a lower surface of the elevating floor 10 is exemplified for description, however, it can be disposed integrally within the elevating floor 10, namely the reinforcement member 11*a*, otherwise.

Figure 22:
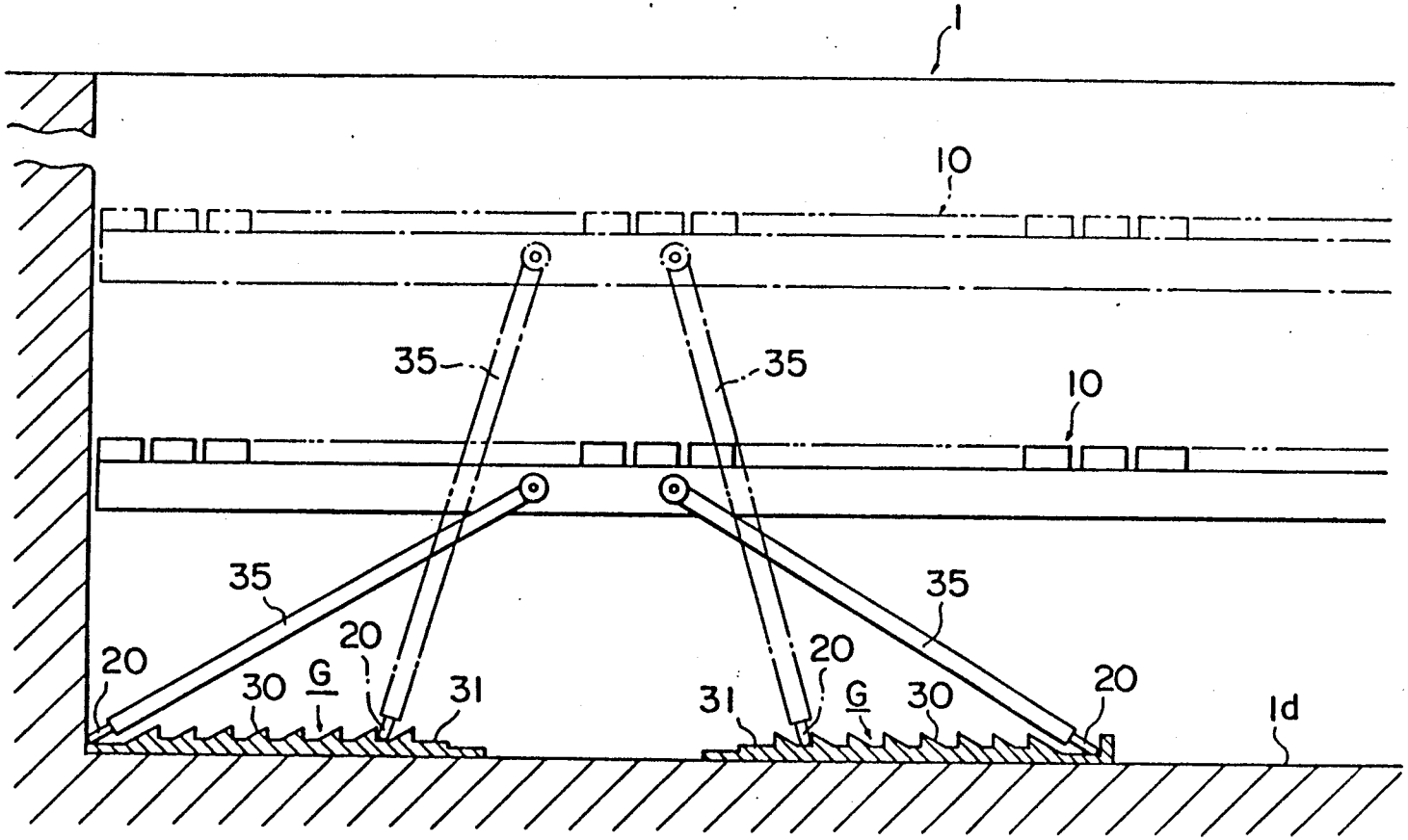
FIG. 22 is a sectional view showing another state where the locking claw is engaged with the claw locking member.
Figure 23:
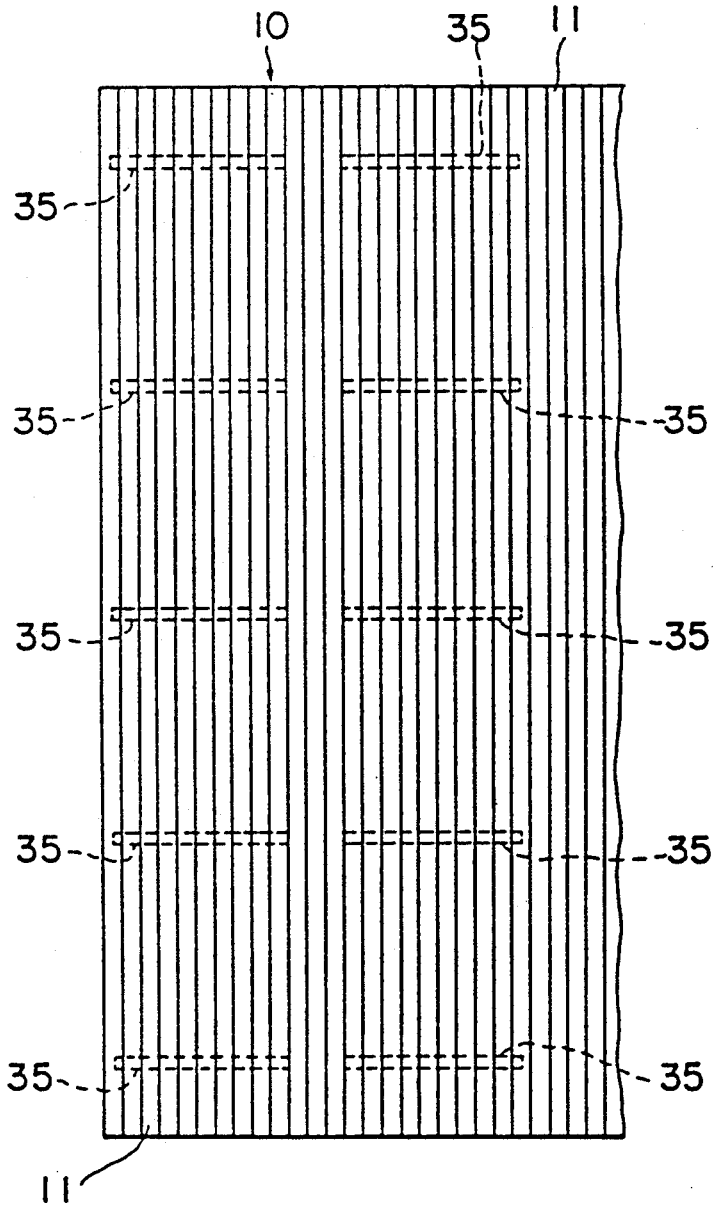
FIG. 23 is a plan view showing the state where arm members are disposed.
Figure 25:
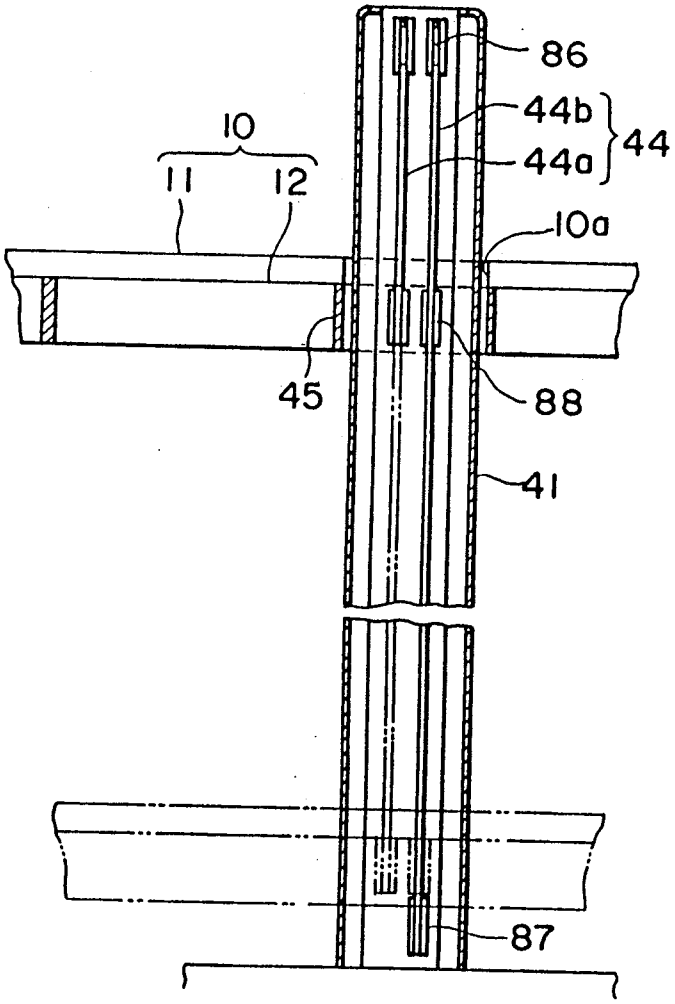
FIG. 25 is a longitudinal sectional view showing a construction of the guide rail.
Figure 24:
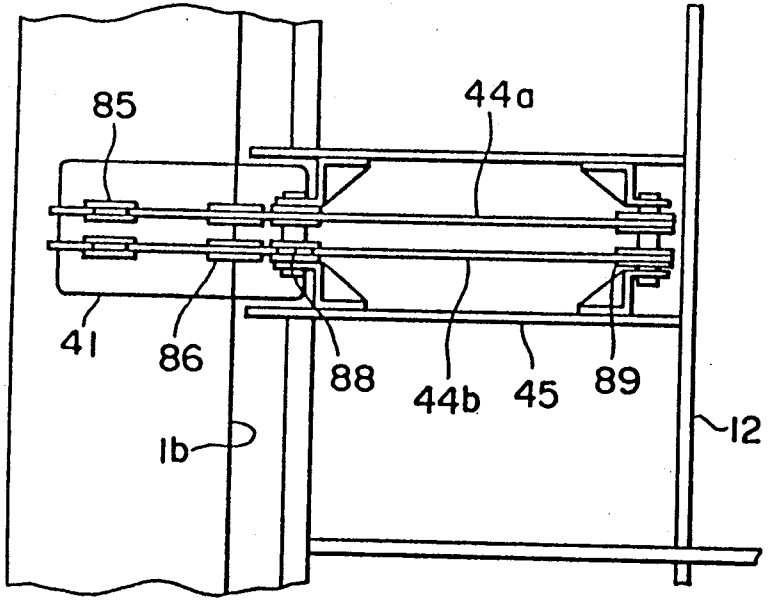
FIG. 24 is a plan view showing a construction of the guide rail of an elevator.
Figure 29:
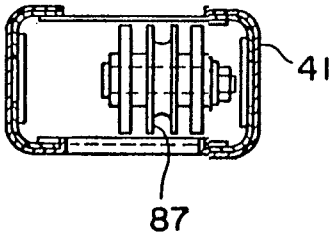
FIG. 29 is a sectional view taken on line D—D of FIG. 28.
Figure 28:
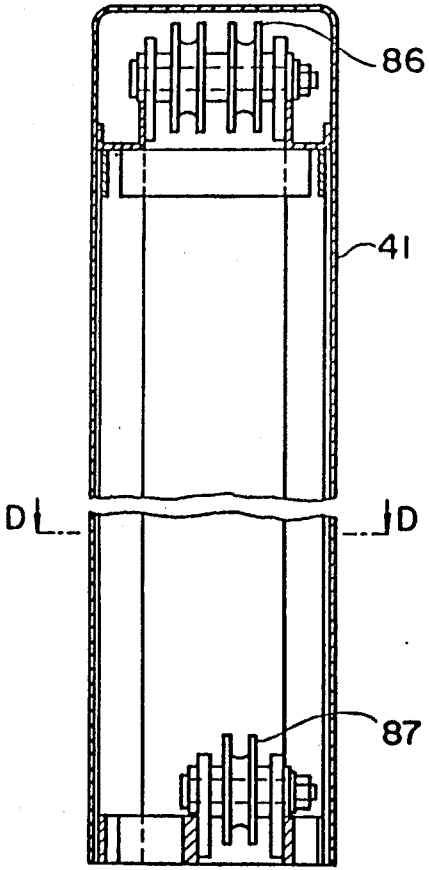
FIG. 28 is a sectional view taken on line C—C of FIG. 26.
Figure 30:
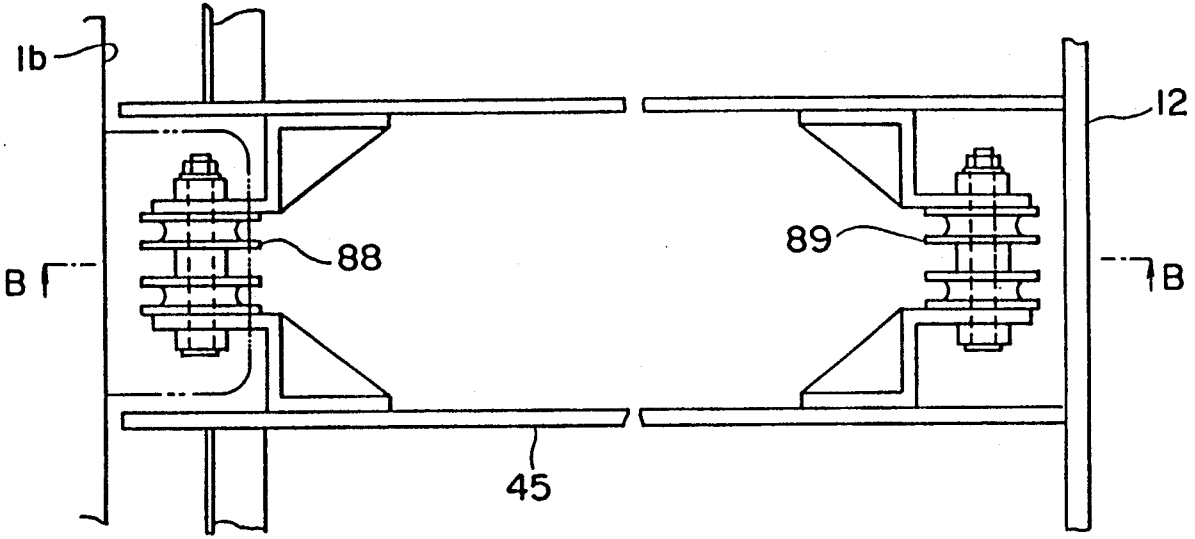
FIG. 30 is a fragmentary enlarged plan view showing pulleys mounted on the support frame.
Figure 31:
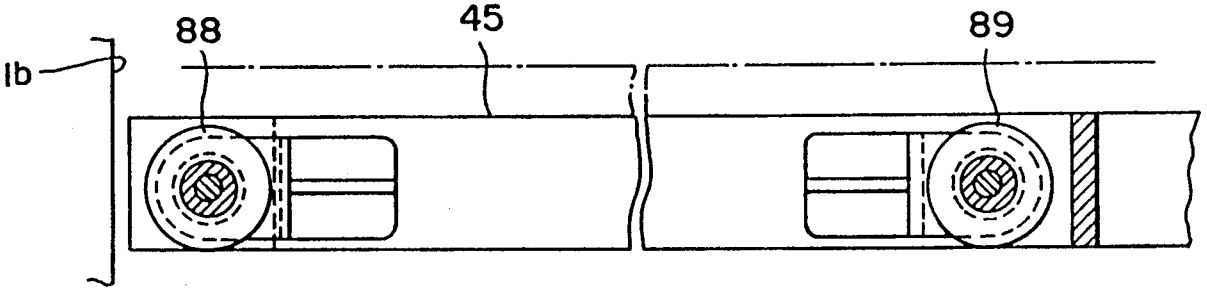
FIG. 31 is a sectional view taken on line B—B of FIG. 30.

FIG. 22 and FIG. 23 represent another example of the locking claw 20 and the claw locking member 30, wherein the guide rail 31 forming the locking member group G is disposed on a floor surface 1*c* of the pool 1 in construction. Accordingly, the locking member group G is constructed to have a plurality of claw locking members 30 provided extendedly horizontally on the floor surface 1*c* of the pool 1.

On the other hand, the locking claw 20 in the example is enclosed in each lower end of a pair of arm members 35 with the upper ends pivoted on a lower surface of the elevating floor 10 and the upright shaped like "/\ " so that its nose is withdrawable opposite to the floor surface 1*c*.

As shown in FIG. 23, the aforementioned pair of arm members 35 are disposed plurally at proper intervals in the direction where, as illustrated, an axis of each arm member 35 is orthogonal to an axis of the flooring 11 constituting the elevating floor 10, or in the direction where both axes are of a direction otherwise, which is not so illustrated therein.

Thus, from disposing the locking claw 20 and the claw locking member 30 as described above, an opening area of the pooll can be utilized as effectively as possible, and an external appearance is also enhanced.

The elevator 40 is disposed, as shown in FIG. 2 and FIG. 25 to FIG. 33, vertically opposite to an opposite side wall of the pool 1, and comprises a plurality (4 pieces in the illustrated example) of inverted L-shaped and hollow guide rails 41 fitted slidably in a notch 10*a* formed on both end portions longitudinally of the elevating floor 10 and guiding the elevating floor 10 for vertical move, a pulley group P provided on the guide rails 41, the support frame 12 and the pool side 1*c* each, a motor M provided on the pool side 1*c* as a driving source, a stepless speed variator 43 as a change gear interlocking with the motor M and having a take-up pulley 42 consisting of a two-throw pulley fixed on one rotating shaft, and a plurality of wire ropes 44 such as rope, wire, cable and the like with one end connected to the take-up pulley 42 and the other end connected to the elevating floor 10.

The aforementioned pulley group P comprises turning-back first and second pulleys 81, 82 consisting of a two-throw pulley provided rotatably on the pool side 1*c*, turning-back third pulleys 83, 83 and fourth pulleys 84, 84 disposed on both sides of the first and the second pulleys 81, 82, a tension fifth pulley 85 and a turning-back sixth pulley 86 consisting of a two-throw pulley which are mounted isolatedly each other horizontally on an upper end of each inverted L-shaped guide rail 41, a seventh pulley 87 mounted rotatably on a lower end of the guide rail 41, a turning-back eighth pulley 88 and a ninth pulley 89 for connecting the wire rope 44 which are mounted isolatedly each other horizontally on each of a plurality (4 pieces in the illustrated example) of brackets 45 fixed on the notch 10*a* of the support frame 12.

Figure 32:
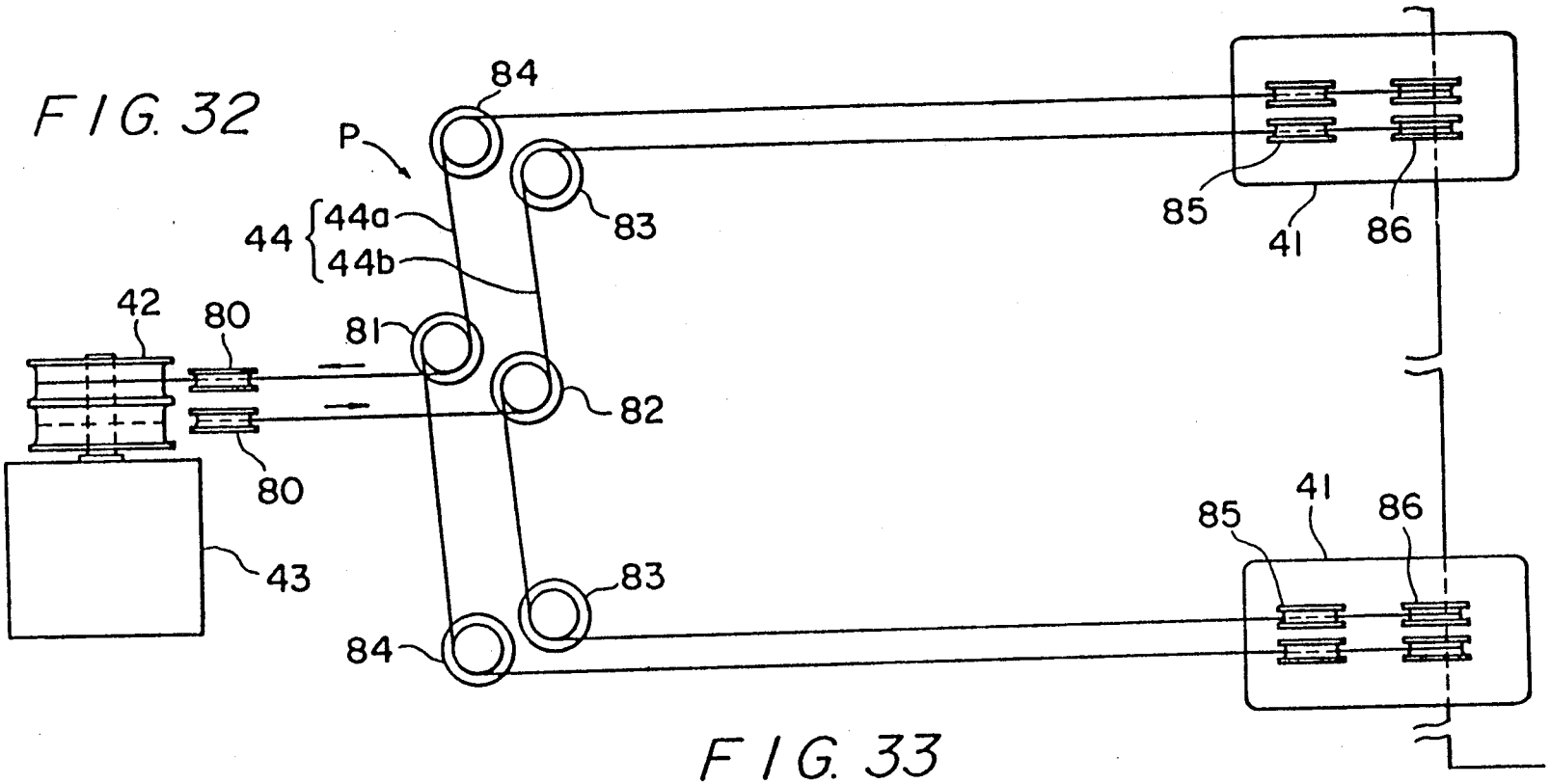
FIG. 32 is a schematic plan view showing the state where wire rope running from take-up pulleys provided on a speed change gear to pulleys on an upper end of the guide rail are disposed.

Then, in FIG. 32, a reference numeral 80 denotes a pulley intended for turning back and tension which is disposed between the take-up pulley 42 and the first and second pulleys 81, 82.

Figure 2:
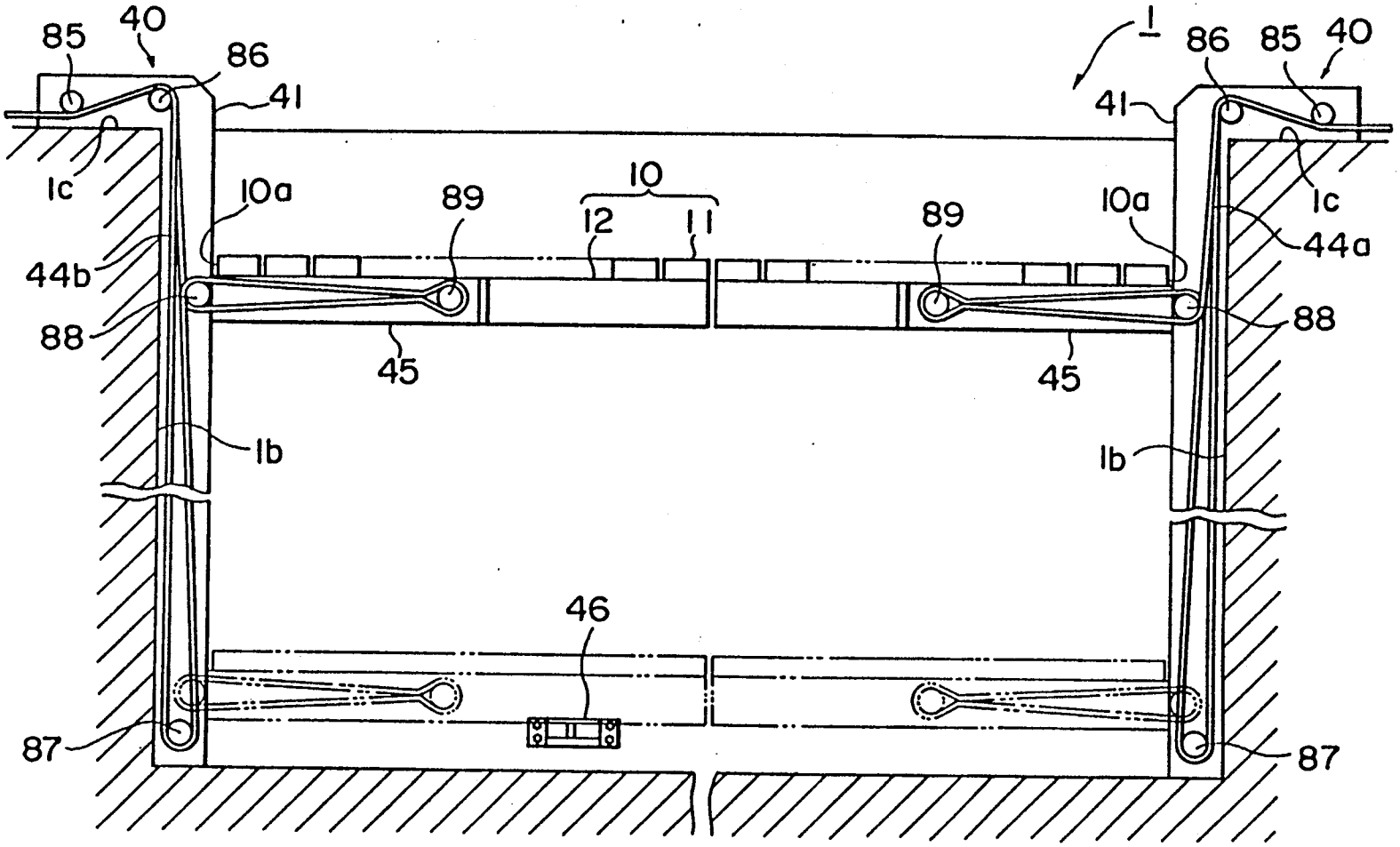
FIG. 2 is a sectional view showing an elevating means.
Figure 33:
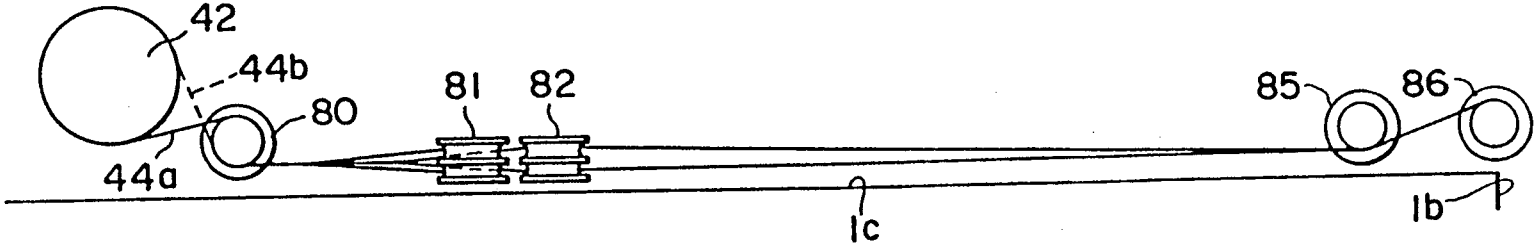
FIG. 33 is a side view of FIG. 32.
Figure 34:
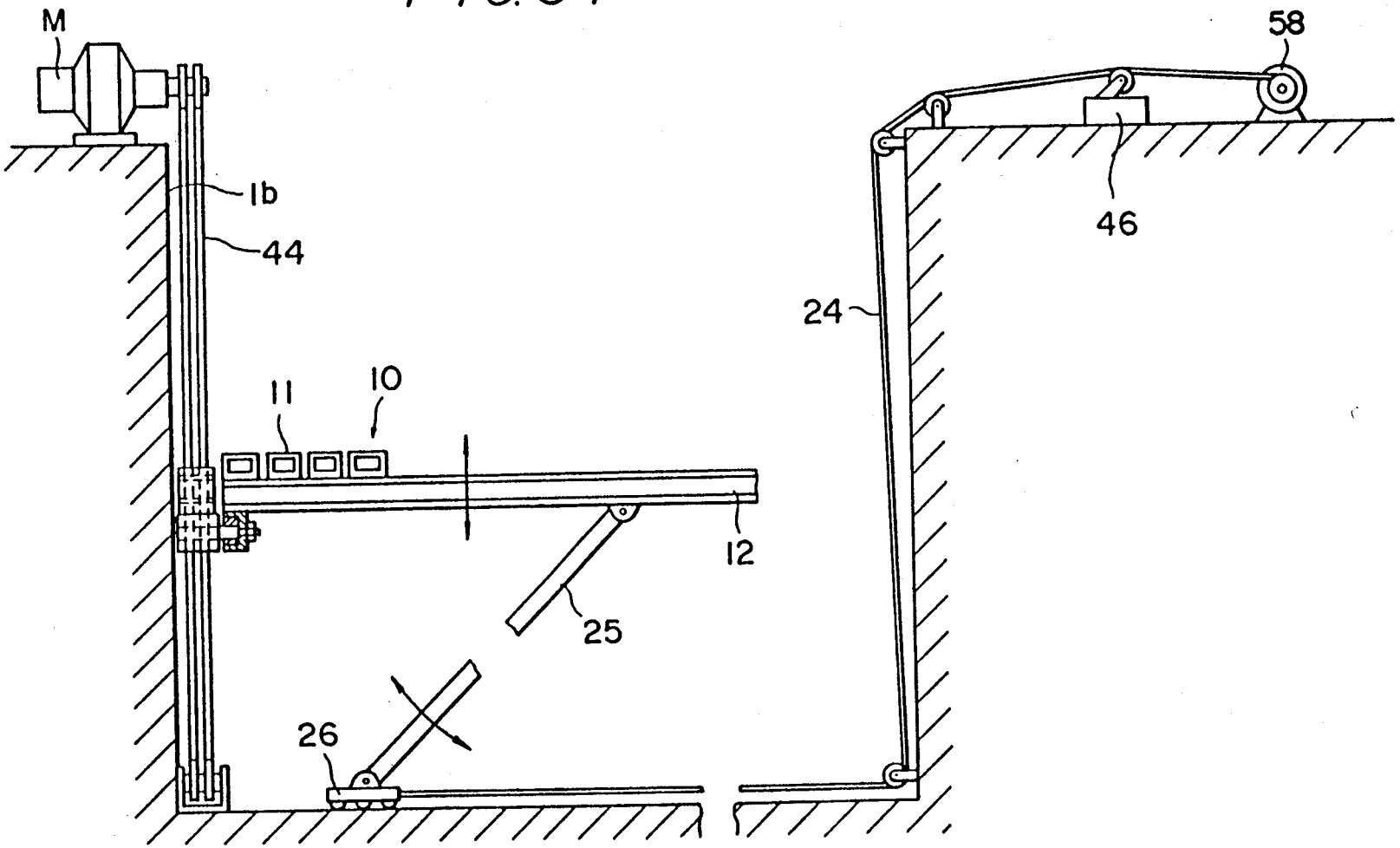
FIG. 34 is a sectional view showing another example of the elevator.

The wire rope 44 coupling the take-up pulley 42 of each stepless speed variator 43 provided on the pool side 1*c* and the elevating floor 10 together consists of an ascending wire rope 44*a* for moving the elevating floor 10 upward and a descending wire rope 44*b* for moving the elevating floor 10 downward, the two wire ropes 44*a*, 44*b* with one end connected to the take-up pulley 42 each are forked before the first and second pulleys 81, 82 respectively as shown in FIG. 32 and FIG. 33, turn at two-throw upper and lower pulleys of the first and second pulleys 81, 82 and part left and right, and the one descending wire rope 44*b* passes through the third pulley 83 and the two-throw fifth and sixth pulleys 85, 86 on an upper end of the guide rail 41, and is bent upward to U-shape, as shown in FIG. 2, at the seventh pulley 87 on a lower end of the support frame 12, turns at the two-throw eighth pulley 88 provided on an end edge portion of the support frame 12 to have the other end connected to the two-throw ninth pulley 89, and the other ascending wire rope 44*a* passes through the fourth pulley 84 and the fourth and fifth pulleys 84, 85 on the upper end of the guide rail 41, turns at the seventh pulley 87 on the end edge portion of the support frame 12 to have the other end connected to the eighth pulley 88, and when the motor M rotates in one direction (forward, for example), the ascending wire rope 44*a* is wound on the take-up pulley 42 and the descending wire rope 44*b* is rewound concurrently, and when the motor M rotates in the counter direction (reversing, for example), the descending wire rope 44*b* is wound on the take-up pulley 42 and the ascending wire rope 44*a* is rewound concurrently.

Accordingly, from running forward or reversing the two motors M provided on the pool side 1*c*, the take-up pulley 42 is reduced to run at a proper speed through the stepless speed variator 43 to wind on or rewind the four wire ropes 44, and thus the support frame 12 or the elevating floor 10 is moved vertically along the guide rail 41 to adjust the depth of water in the pool 1. In this case, the two motors M are controlled to synchronism for equalized rotational speed so that the elevating floor 10 will be moved horizontally in level.

FIG. 34 to FIG. 37 represent another example of the elevator 40, wherein the upper end portion of an arm member 25 is journaled rotatably in a lower surface of the support frame 12 relating to the example. Then, a weight 26 is journaled rotatably in a lower end portion of the arm member 25.

The arm member 25 is formed, for example, of a channel long material.

Figure 36:
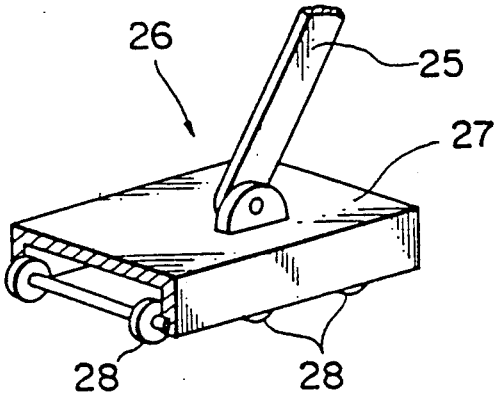
FIG. 36 is a perspective view, partly cutaway, showing a weight disposed on a nose portion of the arm member.

The weight 26 comprises, as shown in FIG. 36, a casing 27, recessed inversely in section, having a necessary weight, a plurality of paired rollers 28 journaled rotatably on a lower surface side of the casing 27, and the rollers 28 are grounded at all times on a bottom of the pool 1.

Figure 35:
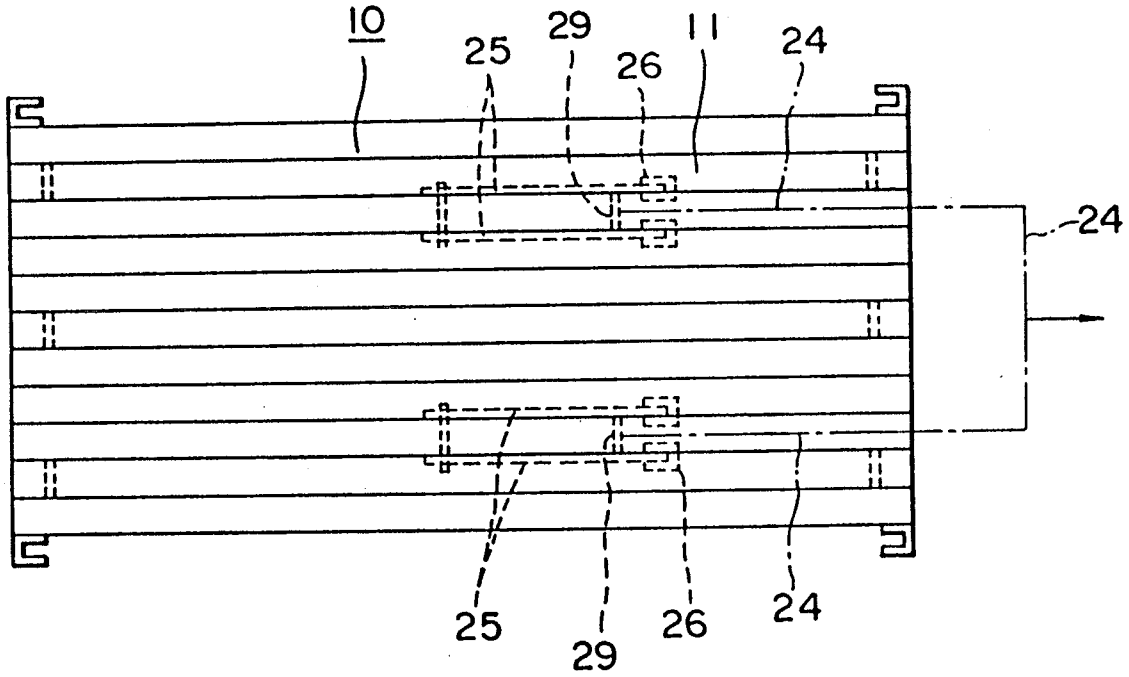
FIG. 35 is a plan view showing a mounting state of arm members of the elevator.

The two arm members 25 constructed as above have the lower end portions interconnected through a coupling member 29 to constitute a set of support legs, which are disposed, as shown in FIG. 35, on a lower surface of the elevating floor 10 at regular intervals correspondingly to dimensions of the pool 1.

Then, one end of an indexing wire rope 24 with the other end coupled to a motor 58 installed on the pool side 1c is coupled to the coupling member 29 nearly a the central portion thereof.

Figure 37:
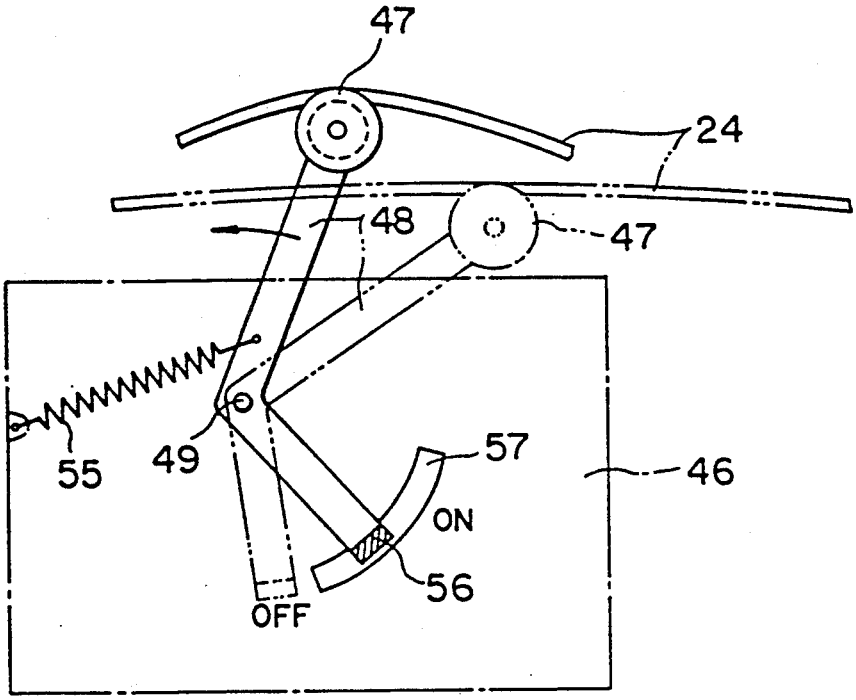
FIG. 37 is an explanatory drawing showing a switch means of the elevator.
Figure 38:
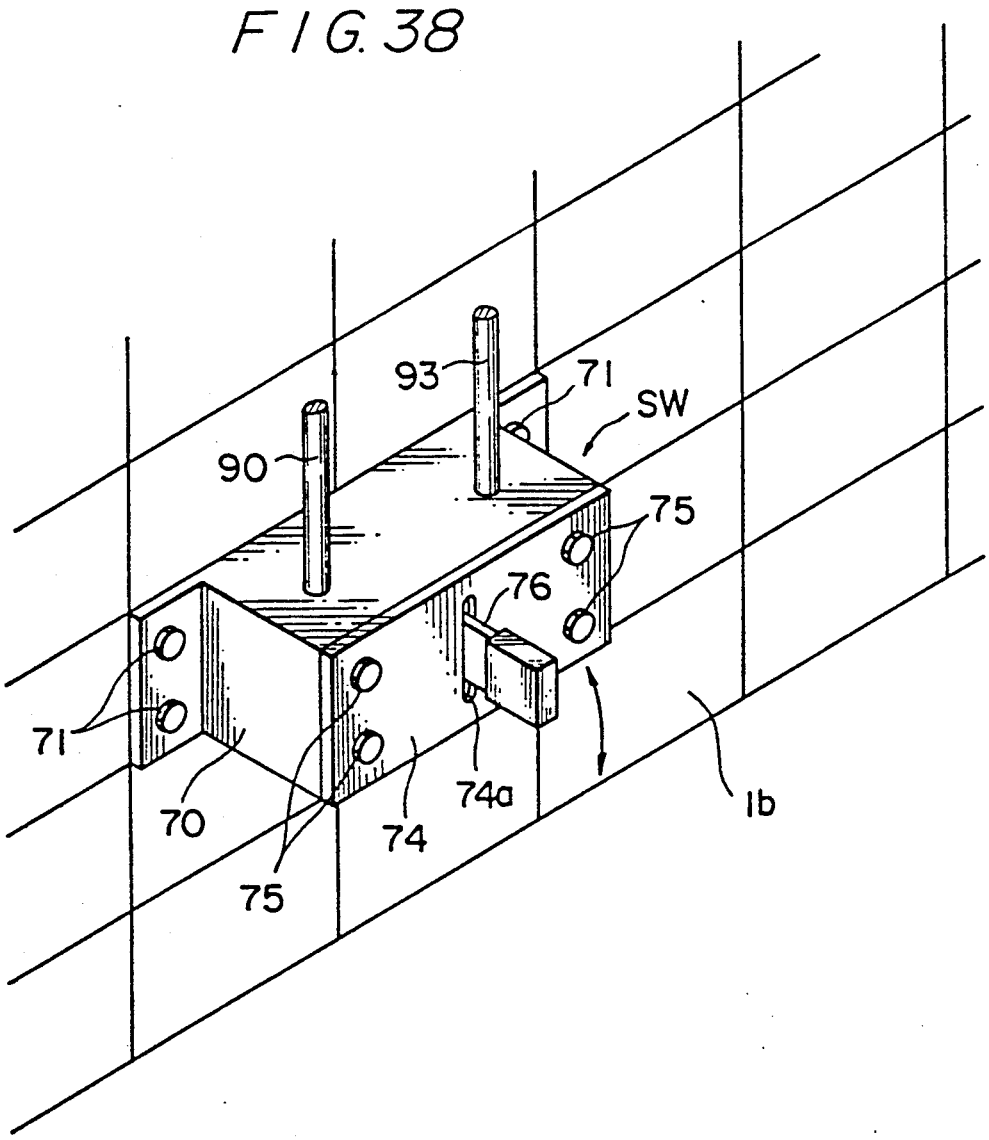
FIG. 38 is a perspective view showing a mounting state of another switch means of the elevator.

A switch 46 for operating the motor 58 comprises, as shown in FIG. 37, a guide pulley 47 having a groove (not indicated) in which the indexing wire rope 24 is fitted, an arm 48 almost <-shaped for journaling the guide pulley 47 rotatably, a shaft 49 for journaling a bend of the arm 48, a spring 55 for energizing the arm 48 normally counterclockwise in FIG. 37, a contact 56 disposed on another end of the arm 48, an almost lunar motor side contact 57 coming in contact with the contact 56 within a predetermined range to actuate the motor 58.

Accordingly, when the motor 58 is rotated to move the elevating floor 10 up to a desired level, the arm member 25 turns on action of the weight 26 in the direction grounding on a bottom surface 1d of the pool 1. In this case, a "deflection" arises on the indexing wire rope 24 coupled to the arm member 25 according to a turning motion of the arm member 25, and thus the arm 48 of the switch 46 is turned counterclockwise in FIG. 37, therefore the contact 56 and the motor side contact 57 come in contact to actuate the motor 58 on, and the indexing wire rope 24 gets tensional.

When the indexing wire rope 24 gets tensional as described, the guide pulley 47 is depressed by the indexing wire rope 24 and turned forcedly clockwise in FIG. 37 against a force of the spring 55, the contact 56 and the motor side contact 57 are isolated to stop the motor 58 operating, and the guide pulley 47 is locked from further turning in the direction where the wire rope bends.

Consequently, since a turning of the arm member 25 in the direction where it comes down is regurated by the indexing wire rope 24 in tension, the elevating floor 10 on which, if so, many people get never descends from the set level position, and a deflection of the elevating floor 10 can be prevented effectively by a support of the arm member 25.

FIG. 38 to FIG. 41 represent another example of a switch SW for controlling the motor M of the elevator 40.

The switch SW according to the example has a housing 70 locked on the inside wall surface 1b near the bottom surface 1d of the pool 1 through a bolt 71.

A light irradiating fiber 72 and a light receiving fiber 73 are disposed within the housing 70.

Then, a cover plate 74 is mounted detachably on the housing 70 through a bolt 75.

A longitudinal slit 74a is formed at the center of the cover plate 74, and a shielding switch plate 76 is inserted in the longitudinal slit 74a.

Figure 39:
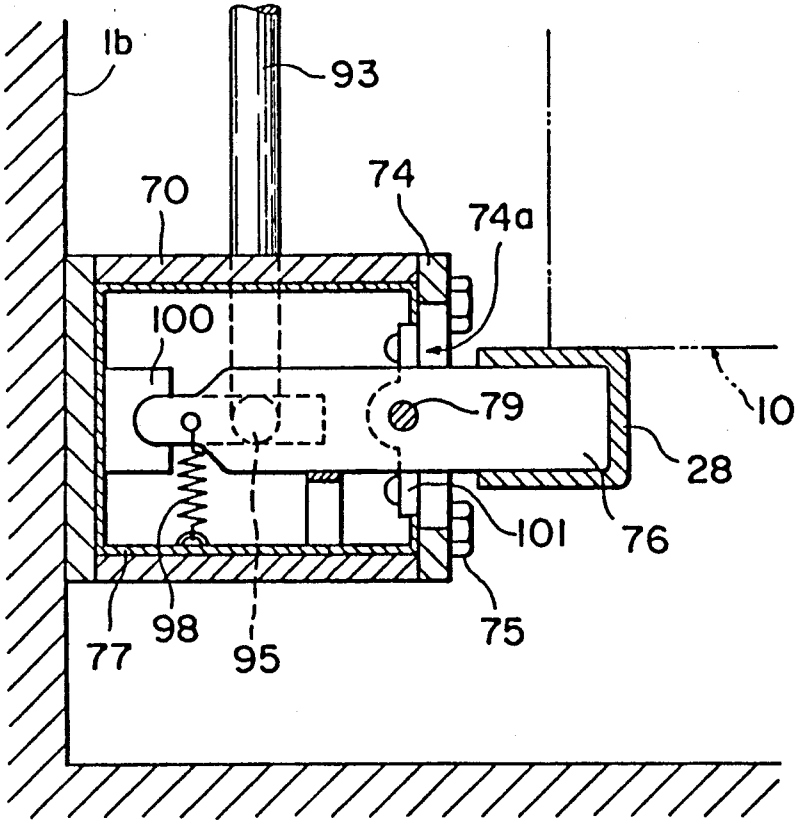
FIG. 39 is a side sectional view showing a construction of the switch means.

The shielding switch plate 76 is disposed to have the other side end portion projected outward of the housing 70, and as shown in FIG. 39, a construction is such that the elevating floor 10 of the pool 1 descends as low as a predetermined level position, comes in contact with the other side end portion of he shielding switch plate 76, and depresses it to turn the switch on.

Figure 40:
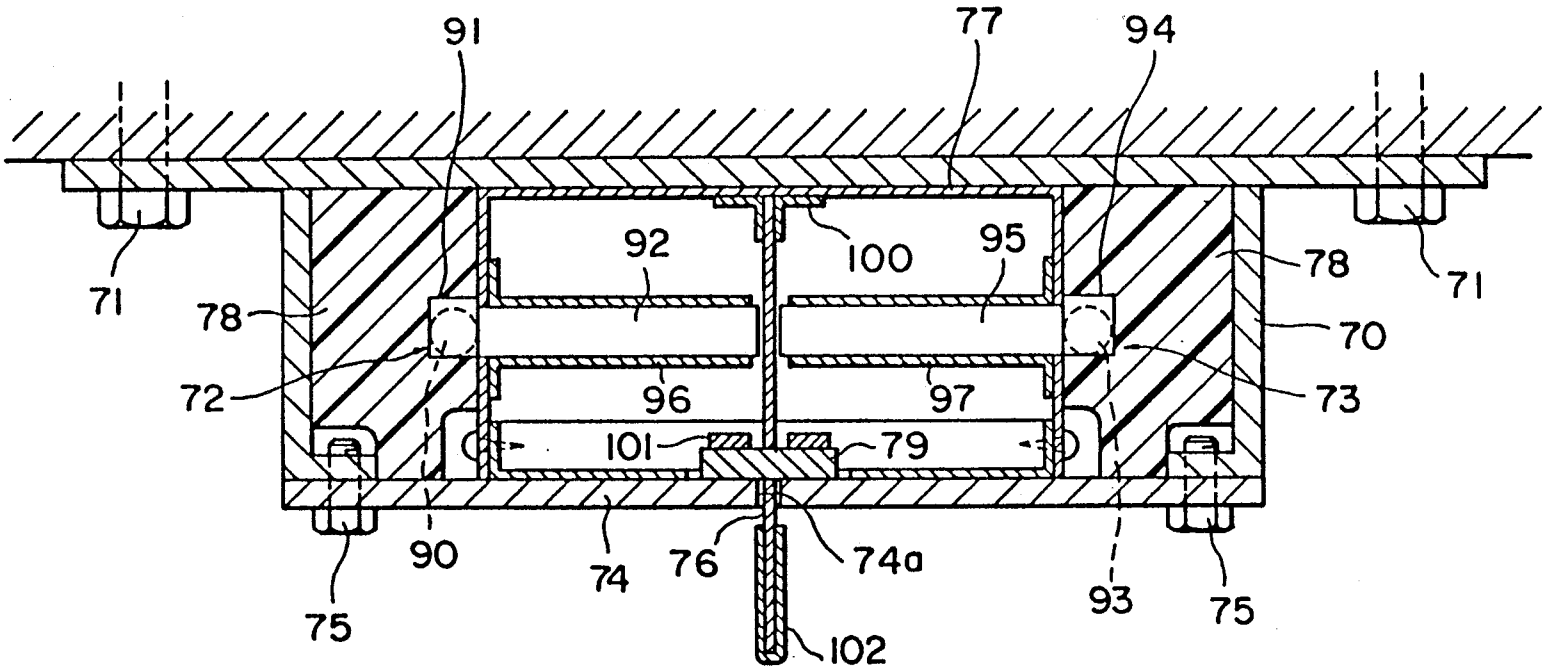
FIG. 40 is a top sectional view of the switch means.
Figure 42:
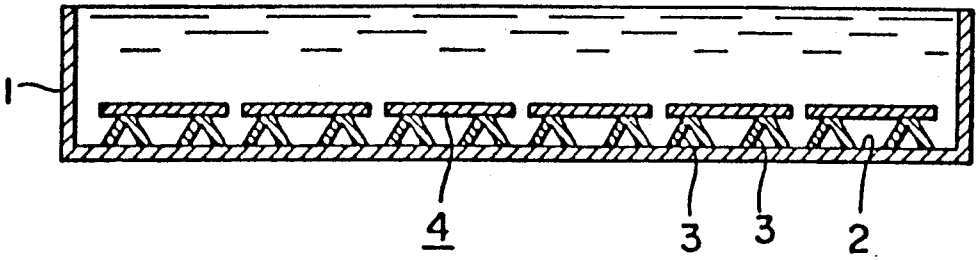
FIG. 42 (PRIOR ART)
FIG. 42 and FIG. 43 are side sectional views of pools showing different prior arts each.
Figure 43:
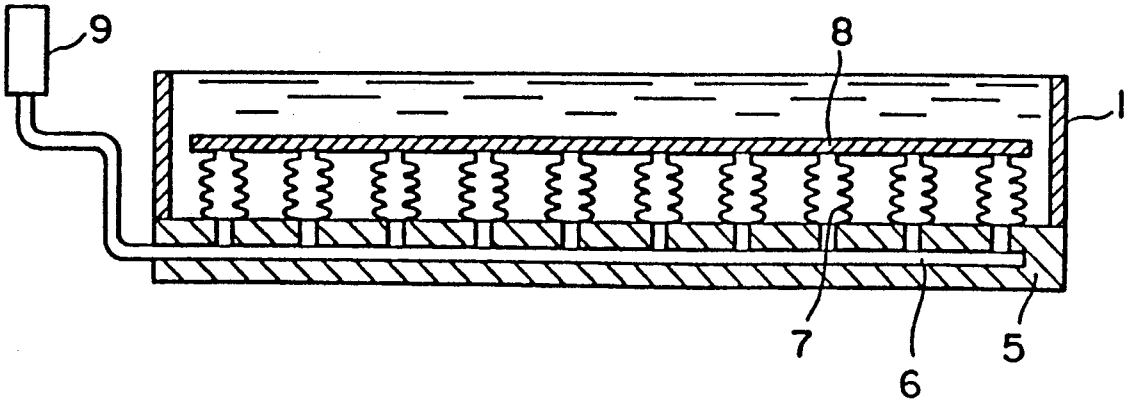
FIG. 43 (PRIOR ART)

That is, as shown in FIG. 39 and FIG. 40, a casing 77 and a packing material 78 provided to sandwich the casing 77 therebetween are disposed within the housing 70.

The casing 77 can be extracted externally from within the housing 70 by removing the bolt 75.

The light irradiating fiber 72 comprises a light incoming fiber 90, a prism 91 connected to a lower end of the light incoming fiber 90, and a horizontal fiber 92 connected to a vertical plane of the prism 91.

The light receiving fiber 73 comprises a light outgoing fiber 93, a prism 94 connected to a lower end of the light outgoing fiber 93, and a horizontal fiber 95 connected to a vertical plane of the prism 94.

Figure 41:
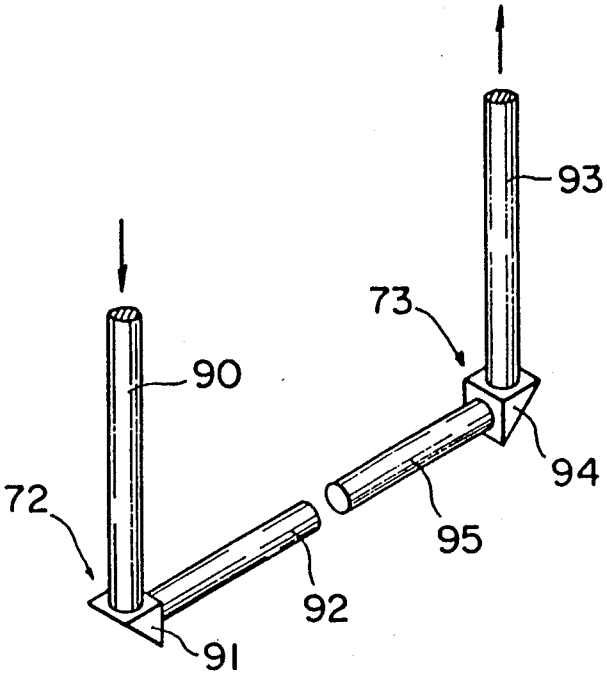
FIG. 41 is an explanatory drawing indicating a light transmission principle of an optical fiber.

Then, opposite end portions of the horizontal fibers 92, 95 are provided so as to be coaxial, as shown in FIG. 41, within the housing 70.

Accordingly, the light is transmitted or cut off by closing or opening the space between opposite end portions of the horizontal fiber 92 and the other horizontal fiber 95.

Then, reference numerals 96, 97 in FIG. 40 denote cover members disposed on outer peripheral surfaces of the horizontal fibers 92, 95 respectively.

With a shaft 79 inserted in the central portion or thereby, the shielding switch plate 76 is turnable both clockwise and counterclockwise in FIG. 39.

Further, one side end portion of the shielding switch plate 76 is energized in a descending direction by a spring 98 disposed therebetween with an inside bottom surface of the casing 77, and is also controlled by a stopper 99 not to descend in excess of a predetermined point.

Then, the one side end portion of the shielding switch plate 76 is prevented from oscillating left and right in FIG. 40 by a guide 100 formed on an inside wall of the casing 77. Further, the shaft 79 journaled in the shielding switch plate 76 is fixed on an inside wall surface of the cover plate 74 by a bearing 101.

The other side end portion of the shielding switch plate 76 is set as projecting externally of the housing 70, and a buffer 102 consisting of plastic or the like is installed thereon.

The packing material 78 in the housing 70 is formed so as to enclose both the prisms 91, 94 therein and also to fix both the prisms 91, 94 at constant positions in the housing 70. Further, the packing material 78 is formed so as to fix the casing 77 at a predetermined position.

For controlling a vertical move of the elevating floor 10 by means of the switch SW constructed as above, in case, for example, the light irradiating fiber 72 and the light receiving fiber 73 are set to "light transmitting state" by the shielding switch plate 76, the elevator 40 can be made "not ready", and if the light irradiating fiber 72 and the light receiving fiber 73 are set to "light cutting-off state" by the shielding switch plate 76, then the elevator 40 can be made "ready". In this case, since the shielding switch plate 76 is interposed between the opposite end portions of the light irradiating fiber 72 and the light receiving fiber 73, alga and others will not stick on both opposite end portions. Needless to say, it can be constructed that while the shielding switch plate 76 allows the light to pass, the elevator 40 will be controlled to "ready state".

Next, for controlling a vertical move of the elevating floor 10 by means of the aforementioned switch SW, if the motor M is started on a start switch (not indicated) to rotate forward, the takeup pulley 42 is reduced in one direction through the stepless speed variator 43, the elevating floor 10 is moved upward along the guide rail 41 through the wire rope 44, and if the motor M is stopped running, the elevating floor 10 stops ascending, and the elevating floor 10 is retained at a stop position by the wire rope 44. On the other hand, if the motor M is reversed by operating a rotation controlling switch (not indicated), the take-up pulley 42 is reduced in the reverse direction through the stepless speed variator 43, and thus the elevating floor 10 is moved downward along the guide rail 41 through the wire rope 44. Then, when the elevating floor 10 reaches an upper bound or lower bound position at the time of vertical move, the shielding switch plate 76 of the switch SW which is set at each position is depressed to rotate and the motor M is stopped rotating automatically.

As described above, meanwhile, from adjusting the quantity of air with which the flooring 11 is charged beforehand so that a weight of the elevating floor 10 will be equalized with a buoyancy underwater, the elevating floor 10 can smoothly be moved vertically on a small driving force, a torque of the motor M necessary for moving the elevating floor 10 can be minimized, and thus a miniature motor can be used economically. Further in this case, an extremely small driving force is yet effective, therefore the elevating floor 10 can be moved vertically by rotating the take-up pulley 42 manually instead of using the motor M.

Then, in the above-mentioned embodiment, the description has referred to the case where the invention is applied to a pool flooring apparatus, however, the invention is not necessarily limited thereto, but can be applied to a case where the bath floor in an old-age home or the like is moved vertically, and if so, then such bath in an old-age home or the like is available for rehabilitating aged persons with dysfunction for cerebral apoplexy or the like.

Further, a means such as chain or the like may be used as the wire rope 44, and if so, a sprocket is used instead of the pulley.

INDUSTRIAL APPLICABILITY

As described above, the flooring apparatus for pool or the like relating to the invention functions effectively that an elevating floor of pool or the like can easily be set at a desired level position on a small power, the elevating floor can be carried very easily and yet assembled easily to accurate dimensions correspondingly to a scale of the pool, and since it is not necessary that a floor of pool or the like be particularly designed, or the pool floor be reconstructed therefor, such inconvenience as will leave the pool unusable for a long period of time never results, a remodeling work can be effected simply in a short time, and a cost of construction can be moderated.

Still further, in the invention, the depth of water can be adjusted simply and easily by moving the elevating floor of pool or the like vertically through wire ropes according to a rotation of the take-up pulley provided on a pool side, therefore one pool or the like can be used for multiple purpose of adults' use, children's use, infants' use and others, thus utilizing pool facilities effectively.

What is claimed is:

1. A floor-level adjusting device of a pool, said device comprising:

a movable floor disposed in the pool, vertically movable relative to the pool, and having a surface area that is substantially the same as the cross-sectional area of the pool, said floor comprising a plurality of hollow floor members having hermetically sealed therein a volume of air that is sufficient to render the floor substantially weightless underwater, and a support frame to which said floor members are fixed;

an elevating means connected to said movable floor for moving said floor vertically up and down relative to the pool, said elevating means comprising a rotatable take-up pulley, rope connected between said take-up pulley and the movable floor, and a plurality of rotatable direction-changing pulleys disposed between said take-up pulley and said movable floor, said rope extending over said direction-changing pulleys; and holding means connected between said movable floor and the pool for supporting the movable floor and preventing said floor from moving downward relative to said pool from any one of a plurality of vertically spaced predetermined positions, said holding means comprising a locking claw, locking claw support means for supporting said locking claw on said movable floor in a manner in which said locking claw is displaced as said floor is moved vertically by said elevating means, and a locking member secured to the pool and extending along an interior surface of the pool, said locking claw being engageable with said locking member in any of said predetermined positions in a manner in which said movable floor is prevented from being moved downward relative to the pool.

2. A floor-level adjusting device of a pool as claimed in claim 1, wherein said support frame comprises at least one group of four generally rectangular panels, and coupling means coupling said panels together, said coupling means including a substantially cross-shaped coupling member extending between the panels of each said group from a location defined at four confronting corners of the panels of each said group, a substantially T-shaped coupling member extending between two adjacent said panels and along an outer edge of the support frame, and an L-shaped coupling member extending along the corner of a said panel at an outer edge of the support frame.

3. A floor-level adjusting device of a pool as claimed in claim 2, wherein each of said generally rectangular panels has four side surfaces and four respective inclined surfaces extending obliquely to and between each of said side surfaces, respectively, and each said cross-shaped coupling member and said T-shaped member have respective inclined surfaces that are complimentary to and abut respective said inclined surfaces of said panels.

4. A floor-level adjusting device of a pool as claimed in claim 1, wherein said floor members are tubular and extend parallel to one another on said support frame.

5. A floor-level adjusting device of a pool as claimed in claim 1, and further comprising a switch operatively connected to said elevating means for stopping said elevating means from operating when said movable floor has reached a predetermined maximum position in the pool, said switch comprising a housing fixed to an inner surface of said pool, a light irradiating fiber means terminating in said housing at a first location for transmitting light in a direction through the switch, a light receiving fiber means terminating in said housing at a second location spaced from said first location for receiving light transmitted by said light irradiating fiber means, and a switch plate movably supported by said housing between a light cutting-off position at which said switch plate is disposed between said fiber means and blocks the transmission of light from said irradiation fiber means to said light receiving fiber means and a light-transmitting position at which said switch plate allows the transmission of light from said irradiation fiber means to said light receiving fiber means, said switch plate engageable by said moving floor and movable from one of said light-transmitting and said light cutting-off positions thereof to the other of said light transmitting and light cutting-off positions when said floor has been moved to said predetermined maximum position.

6. A floor-level adjusting device of a pool as claimed in claim 1, wherein said locking member extends vertically along an interior side surface of the pool, said locking claw is extendable and retractable relative to said locking claw support means, and said locking claw support means is connected to the movable floor at the undersurface thereof, said locking claw extending from said locking claw support means to engage said locking member when said movable floor is at any one of said vertically spaced predetermined positions, and said locking claw being retracted toward said locking claw support means as said movable floor is moved by said elevating means upwardly between said vertically spaced predetermined positions.

7. A floor-level adjusting device of a pool as claimed in claim 1, wherein said locking member extends along a bottom interior of the pool, and said locking claw support means comprises an arm pivotally connected to said floor and extending between said floor and said locking member.

* * * * *